US012509754B2

(12) United States Patent
Kusumi et al.

(10) Patent No.: US 12,509,754 B2
(45) Date of Patent: Dec. 30, 2025

(54) HOT-STAMPED MEMBER AND STEEL SHEET FOR HOT STAMPING

(71) Applicant: NIPPON STEEL CORPORATION, Tokyo (JP)

(72) Inventors: Kazuhisa Kusumi, Tokyo (JP); Katsuhiro Fuchigami, Tokyo (JP); Takashi Aramaki, Tokyo (JP); Hideaki Irikawa, Tokyo (JP); Haruhiko Eguchi, Tokyo (JP); Takahisa Honda, Tokyo (JP); Takashi Morohoshi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 630 days.

(21) Appl. No.: 17/777,574

(22) PCT Filed: Nov. 25, 2020

(86) PCT No.: PCT/JP2020/043832
§ 371 (c)(1),
(2) Date: May 17, 2022

(87) PCT Pub. No.: WO2021/106936
PCT Pub. Date: Jun. 3, 2021

(65) Prior Publication Data

US 2023/0028362 A1 Jan. 26, 2023

(30) Foreign Application Priority Data

Nov. 26, 2019 (JP) ..... 2019-213593

(51) Int. Cl.
*C22C 38/58* (2006.01)
*C22C 38/00* (2006.01)
(Continued)

(52) U.S. Cl.
CPC ..... *C22C 38/58* (2013.01); *C22C 38/008* (2013.01); *C22C 38/02* (2013.01); *C22C 38/06* (2013.01);
(Continued)

(58) Field of Classification Search
CPC .. C21D 1/673; C21D 2211/004; C21D 8/005; C21D 9/0068; C21D 9/46; C21D 9/48;
(Continued)

(56) References Cited

U.S. PATENT DOCUMENTS

2004/0055667 A1 3/2004 Takada et al.
2014/0241934 A1* 8/2014 Morohoshi ..... C21D 8/0263 420/83

(Continued)

FOREIGN PATENT DOCUMENTS

CN 1483090 A 3/2004
EP 2 213 753 A1 8/2010

(Continued)

*Primary Examiner* — Nicholas A Wang
(74) *Attorney, Agent, or Firm* — Birch, Stewart, Kolasch & Birch, LLP

(57) ABSTRACT

There is provided a hot-stamped member or a steel sheet for hot stamping having a chemical composition including, in mass %, C: 0.25% or more and 0.55% or less, Si: 0.001% or more and 2.0% or less, Mn: 0.3% or more and 3.0% or less, P: 0.02% or less, S: 0.003% or less, Al: 0.005% or more and 1.0% or less, Cr: 0% or more and 1.0% or less, Mo: 0% or more and 1.0% or less, N: 0.02% or less, Ca: 0% or more and 0.0010% or less, B: 0.0005% or more and 0.01% or less, one or two or more selected from the group consisting of Ti: 0.005% or more and 0.5% or less, Nb: 0.005% or more and 0.5% or less, V: 0.005% or more and 0.5% or less, and Zr: 0.005% or more and 0.5% or less, and Ni+Cu+Sn: 0% or more and 2% or less, and a remainder consisting of Fe and impurities.

20 Claims, 2 Drawing Sheets

(51) Int. Cl.

| | |
|---|---|
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C22C 38/42* (2013.01); *C22C 38/44* (2013.01); *C22C 38/46* (2013.01); *C22C 38/48* (2013.01); *C22C 38/50* (2013.01); *C22C 38/54* (2013.01)

(58) Field of Classification Search
CPC ..... C22C 38/002; C22C 38/008; C22C 38/02; C22C 38/04; C22C 38/06; C22C 38/20; C22C 38/22; C22C 38/24; C22C 38/26; C22C 38/28; C22C 38/32; C22C 38/40; C22C 38/42; C22C 38/44; C22C 38/46; C22C 38/48; C22C 38/50; C22C 38/54; C22C 38/58; C22C 38/001; C22C 38/34; C22C 38/38
See application file for complete search history.

(56) References Cited

U.S. PATENT DOCUMENTS

| | | | |
|---|---|---|---|
| 2015/0050519 | A1* | 2/2015 | Nonaka ..... C22C 38/18 148/504 |
| 2016/0053352 | A1 | 2/2016 | Aono et al. |
| 2017/0096724 | A1 | 4/2017 | Hikida et al. |
| 2019/0390295 | A1 | 12/2019 | Nakagawa et al. |
| 2020/0354806 | A1 | 11/2020 | Takashima et al. |

FOREIGN PATENT DOCUMENTS

| | | | |
|---|---|---|---|
| EP | 3 604 500 | A1 | 2/2020 |
| JP | 2017-43825 | A | 3/2017 |
| WO | WO 2014/175377 | A1 | 10/2014 |
| WO | WO 2015/147216 | A1 | 10/2015 |
| WO | WO 2018/174270 | A1 | 9/2018 |
| WO | WO 2018/179839 | A1 | 10/2018 |
| WO | WO 2019/003540 | A1 | 1/2019 |

* cited by examiner

HOT-STAMPED MEMBER AND STEEL SHEET FOR HOT STAMPING

TECHNICAL FIELD

The present invention relates to a hot-stamped member and a steel sheet for hot stamping. Priority is claimed on Japanese Patent Application No. 2019-213593, filed Nov. 26, 2019, the content of which is incorporated herein by reference.

BACKGROUND ART

Hot-stamped parts are used for framework parts of a vehicle body, and are often used as reinforcing parts around a cabin to secure a living space for occupants and as a path for transmitting a load during collision. A higher strength is also required for hot-stamped parts in order to support weight reduction of a vehicle body for fuel efficiency regulations and sophistication of collision tests.

However, since there is a high risk of occurrence of hydrogen embrittlement cracks as the strength increases, measures for minimizing hydrogen embrittlement cracks are required.

For example, in the technology of Patent Document 1, in order to achieve both hardness stability and delayed fracture resistance, microstructures are controlled and the cleanliness of inclusions is regulated. In addition, in the technology of Patent Document 2, in order to obtain tensile strength and toughness, the precipitation amount of microstructures and inclusions is controlled.

CITATION LIST

Patent Document

Patent Document 1

PCT International Publication No. WO 2015/147216

Patent Document 2

Japanese Unexamined Patent Application, First Publication No. 2017-043825

SUMMARY OF THE INVENTION

Problems to Be Solved by the Invention

The inventors have conducted studies regarding hydrogen embrittlement cracks of steel hot stamping parts having a tensile strength of larger than 1.6 GPa, and have confirmed that there are inclusions containing $CaO—Al_2O_3$ at starting points of hydrogen embrittlement cracks.

Ca is an element that is added to steel in order to control the morphology of sulfides. Stretched MnS is minimized because of generation of spherical CaS. It is said that toughness is improved when stretched MnS is minimized.

However, according to studies by the inventors, it has been found that, when Ca is added, coarse inclusions containing $CaO—Al_2O_3$ as shown in FIG. 1 are generated, and the inclusions become starting points of hydrogen embrittlement cracks. In FIG. 1, the black part is an inclusion containing $CaO—Al_2O_3$, and the white part is a steel matrix.

The present invention has been made in view of such circumstances, and an object of the present invention is to provide a hot-stamped member and a steel sheet for hot stamping which can prevent hydrogen embrittlement cracks due to coarse inclusions containing $CaO—Al_2O_3$ while maintaining a desired tensile strength.

Means for Solving the Problem (1) A hot-stamped member according to one aspect of the present invention is a hot-stamped member having a chemical composition including, in mass %,
C: 0.25% or more and 0.55% or less,
Si: 0.001% or more and 2.0% or less,
Mn: 0.3% or more and 3.0% or less,
P: 0.02% or less,
S: 0.003% or less,
Al: 0.005% or more and 1.0% or less,
Cr: 0% or more and 1.0% or less,
Mo: 0% or more and 1.0% or less,
N: 0.02% or less,
Ca: 0% or more and 0.0010% or less,
B: 0.0005% or more and 0.01% or less,
one or two or more selected from the group consisting of Ti: 0.005% or more and 0.5% or less, Nb: 0.005% or more and 0.5% or less, V: 0.005% or more and 0.5% or less, and Zr: 0.005% or more and 0.5% or less,
Ni+Cu+Sn: 0% or more and 2% or less, and
a remainder consisting of Fe and impurities,
wherein a tensile strength of the hot-stamped member left in the air at a room temperature of 20 to 30° C. for 48 hours or longer exceeds 1600 MPa, and
wherein a major axis of an inclusion containing $CaO—Al_2O_3$ contained in the hot-stamped member is 50 μm or less.

(2) A hot-stamped member according to one aspect of the present invention is a hot-stamped member having a chemical composition including, in mass %, C: 0.25% or more and 0.55% or less,
Si: 0.001% or more and 2.0% or less,
Mn: 0.3% or more and 3.0% or less,
P: 0.02% or less,
S: 0.003% or less,
Al: 0.005% or more and 1.0% or less,
Cr: 0% or more and 1.0% or less,
Mo: 0% or more and 1.0% or less,
N: 0.02% or less,
Ca: 0% or more and 0.0010% or less,
B: 0.0005% or more and 0.01% or less,
one or two or more selected from the group consisting of Ti: 0.005% or more and 0.5% or less, Nb: 0.005% or more and 0.5% or less, V: 0.005% or more and 0.5% or less, and Zr: 0.005% or more and 0.5% or less,
Ni+Cu+Sn: 0% or more and 2% or less, and
a remainder consisting of Fe and impurities,
wherein a tensile strength of the hot-stamped member left in the air at a room temperature of 20 to 30° C. for 48 hours or longer exceeds 1600 MPa, and
wherein, when a uniform elongation is $El_1$ (%) and a total elongation measured using a tensile test piece of the hot-stamped member charged with hydrogen so that an amount of diffusible hydrogen is 0.5±0.1 wt. ppm is $El_2$ (%), $(El_2/El_1)\times100\geq100(\%)$ is satisfied.

(3) In the hot-stamped member according to (1) or (2), a maximum length of MnS present in a central part of a sheet thickness may be 300 μm or less.

(4) The hot-stamped member according to any one of (1) to (3), may include, in mass %, Ni+Cu+Sn: 0.005% or more and 2% or less.

(5) In the hot-stamped member according to any one of (1) to (4), a plating layer may be provided on a surface.

(6) A steel sheet for hot stamping according to one aspect of the present invention is a steel sheet for hot stamping having a chemical composition including, in mass %, C: 0.25% or more and 0.55% or less,
Si: 0.001% or more and 2.0% or less,
Mn: 0.3% or more and 3.0% or less,
P: 0.02% or less,
S: 0.003% or less,
Al: 0.005% or more and 1.0% or less,
Cr: 0% or more and 1.0% or less,
Mo: 0% or more and 1.0% or less,
N: 0.02% or less,
Ca: 0% or more and 0.0010% or less,
B: 0.0005% or more and 0.01% or less,
one or two or more selected from the group consisting of Ti: 0.005% or more and 0.5% or less, Nb: 0.005% or more and 0.5% or less, V: 0.005% or more and 0.5% or less, and Zr: 0.005% or more and 0.5% or less,
Ni+Cu+Sn: 0% or more and 2% or less, and
a remainder consisting of Fe and impurities,
wherein a tensile strength measured using a tensile test piece obtained by heating the steel sheet for hot stamping at 950° C. for 1 minute and then cooling to 200° C. or lower at an average cooling rate of 30 to 100° C./s, the steel sheet for hot stamping being left in the air at a room temperature of 20 to 30° C. for 48 hours or longer, exceeds 1600 MPa, and
wherein a major axis of an inclusion containing CaO—$Al_2O_3$ contained in the steel sheet for hot stamping is 50 μm or less.

(7) A steel sheet for hot stamping according to one aspect of the present invention is a steel sheet for hot stamping having a chemical composition including, in mass %, C: 0.25% or more and 0.55% or less,
Si: 0.001% or more and 2.0% or less,
Mn: 0.3% or more and 3.0% or less,
P: 0.02% or less,
S: 0.003% or less,
Al: 0.005% or more and 1.0% or less,
Cr: 0% or more and 1.0% or less,
Mo: 0% or more and 1.0% or less,
N: 0.02% or less,
Ca: 0% or more and 0.0010% or less,
B: 0.0005% or more and 0.01% or less,
one or two or more selected from the group consisting of Ti: 0.005% or more and 0.5% or less, Nb: 0.005% or more and 0.5% or less, V: 0.005% or more and 0.5% or less, and Zr: 0.005% or more and 0.5% or less,
Ni+Cu+Sn: 0% or more and 2% or less, and
a remainder consisting of Fe and impurities,
wherein a tensile strength measured using a tensile test piece obtained by heating the steel sheet for hot stamping at 950° C. for 1 minute and then cooling to 200° C. or lower at an average cooling rate of 30 to 100° C./s, the steel sheet for hot stamping being left at a room temperature of 20 to 30° C. for 48 hours or longer, exceeds 1600 MPa, and
wherein, when a uniform elongation is $El_3$ (%) and a total elongation measured using the tensile test piece charged with hydrogen so that an amount of diffusible hydrogen is 0.5±0.1 wt. ppm is $El_4$ (%), $(El_4/El_3)\times100\geq100$(%) is satisfied.

(8) In the steel sheet for hot stamping according to (6) or (7), a maximum length of MnS present in a central part of a sheet thickness may be 300 μm or less.

(9) The steel sheet for hot stamping according to any one of (6) to (8), may include, in mass %, Ni+Cu+Sn: 0.005% or more and 2% or less.

(10) In the steel sheet for hot stamping according to any one of (6) to (9), a plating layer may be provided on a surface.

Effects of the Invention

According to the present invention, there are provided a hot-stamped member and a steel sheet for hot stamping which can prevent hydrogen embrittlement cracks while maintaining a desired tensile strength.

EMBODIMENTS FOR IMPLEMENTING THE INVENTION

Figure 1:
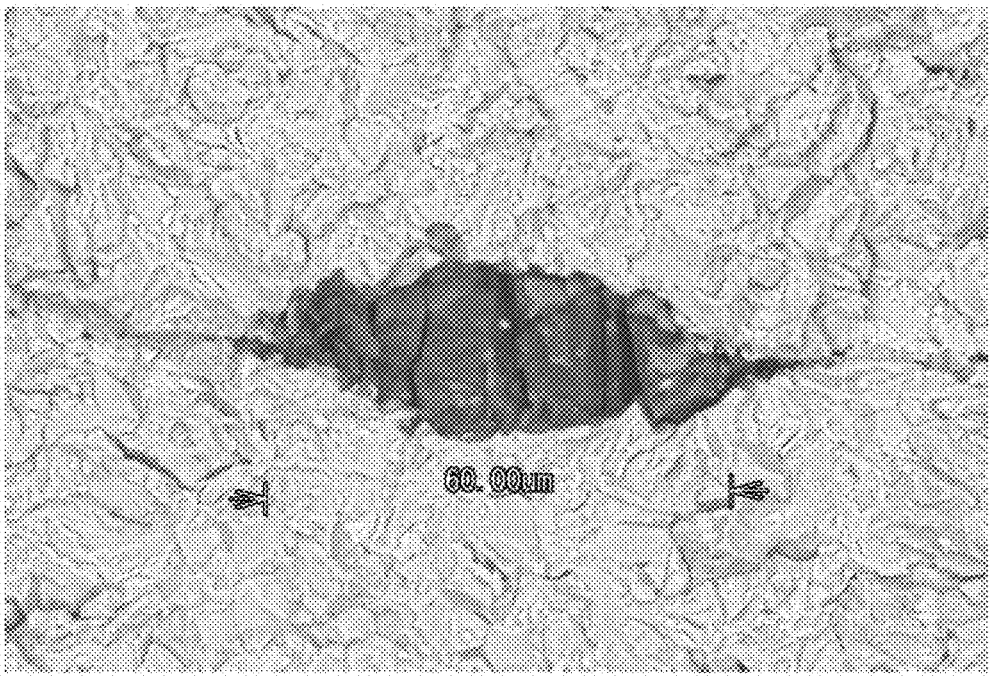
FIG. 1 is a reflection electron image near CaO—$Al_2O_3$ observed on a fracture surface of hydrogen embrittlement cracks.

The inventors have found that, when a material containing hydrogen is subjected to a tensile test, fracture occurs because of hydrogen embrittlement, and coarse inclusions containing CaO—$Al_2O_3$ are present at the starting point. Thus, hydrogen embrittlement cracks due to the above inclusions that become starting points have been confirmed.

In addition, the inventors have also found that, since the number of such coarse inclusions is small, it is difficult to find them by observing a cross section of a steel material generally used to measure cleanliness.

The inventors conducted a tensile test on a material containing hydrogen, observed a fracture surface, and evaluated the sizes of inclusions that become starting points of hydrogen embrittlement cracks, and found that a major axis of such inclusions is larger than 50 μm. Based on this result, the inventors found that it is possible to prevent hydrogen embrittlement cracks by restricting the major axis of such inclusions to 50 μm or less.

Hereinafter, embodiments of the present invention will be exemplified, and it is obvious that the present invention is not limited to examples to be described below. In the following description, specific numerical values and materials will be exemplified, but other numerical values and materials may be applied as long as the effects of the present invention can be obtained. In addition, components of the following embodiments can be combined with each other.

First Embodiment

A hot-stamped member according to a first embodiment is a hot-stamped member having a chemical composition including, in mass %, C: 0.25% or more and 0.55% or less,
Si: 0.001% or more and 2.0% or less,
Mn: 0.3% or more and 3.0% or less,
P: 0.02% or less,
S: 0.003% or less,
Al: 0.005% or more and 1.0% or less,
Cr: 0% or more and 1.0% or less,
Mo: 0% or more and 1.0% or less,
N: 0.02% or less, Ca: 0% or more and 0.0010% or less, B: 0.0005% or more and 0.01% or less, one or two or more selected from the group consisting of Ti: 0.005% or more and 0.5% or less, Nb: 0.005% or more and 0.5% or less, V: 0.005% or more and 0.5% or less, and Zr: 0.005% or more and 0.5% or less, Ni+Cu+Sn: 0% or more and 2% or less, and a remainder consisting of Fe and impurities.

In the hot-stamped member according to the first embodiment, the tensile strength of the hot-stamped member left in the air at a room temperature of 20 to 30° C. for 48 hours or longer exceeds 1,600 MPa, and the major axis of inclusions containing $CaO—Al_2O_3$ contained in the hot-stamped member is 50 μm or less.

The chemical composition of the hot-stamped member according to the first embodiment will be described.

(C: 0.25% or More and 0.55% or Less)

C is an element that is added to secure a material with a structure after cooling, the element being martensite, and it is necessary to add 0.25% or more of C in order to secure a strength of 1,600 MPa or more. If the addition amount is too large, it is difficult to secure strength during impact deformation, and thus the upper limit is 0.55%.

(Si: 0.001% or More and 2.0% or Less)

Si is a solid solution strengthening alloy element, and is necessary to secure strength, but if the amount exceeds 2.0%, a surface scale problem occurs. Therefore, the amount of Si is set to 2.0% or less. In addition, when a plating treatment is performed on the surface of a steel sheet, it is preferable to set the upper limit of Si to 1.0% because plating properties deteriorate if the amount of Si added is large. Although there is no major problem with materials when the addition amount is reduced, the lower limit of the amount of Si added is set to 0.001% because the steelmaking cost increases if the addition amount is small. Here, more preferably, the amount of Si added is in a range of 0.01 to 0.5%.

(Mn: 0.3% or More and 3.0% or Less)

Mn is an element that improves the strength and hardenability, and if the amount is less than 0.2%, sufficient strength during quenching cannot be obtained, but if the addition amount exceeds 3.0%, this effect becomes maximized, and thus the amount of Mn is set to be in a range of 0.3 to 3.0%. The amount of Mn added is more preferably 2.2% or less.

(Al: 0.005% or More and 1.0% or Less)

Al is a necessary element used as a deoxidizing material for molten steel, and is also an element fixing N, and the amount thereof greatly influences the crystal grain size and mechanical properties. In order to obtain such an effect, a content of 0.005% or more is required, but if it exceeds 1.0%, the number of non-metal inclusions increases, and surface defects are likely to occur in the product. Therefore, the amount of Al is set to be within a range of 0.005 to 1.0%. The amount of Al added is more preferably 0.01% or more and still more preferably 0.5% or less.

(S: 0.003% or Less)

S influences non-metal inclusions in steel, and deteriorates toughness and hydrogen embrittlement resistance. Therefore, the amount of S is set to 0.003% or less. Here, the amount of S is preferably 0.001% or less.

(P: 0.02% or Less)

Since P is an element that adversely influences toughness and hydrogen embrittlement resistance, the amount of P is set to 0.02% or less. Here, the amount of P is preferably 0.015% or less. In addition, the amount of P is more preferably 0.010% or less.

The chemical composition of the hot-stamped member according to the present embodiment may further include at least one optional element among Cr, Mo, Ca, Ni, Cu, and Sn instead of a part of the above Fe. These optional elements can be incorporated according to a purpose. Therefore, it is not necessary to limit the lower limit value of these optional elements, and the lower limit value may be 0%. In addition, even if these optional elements are contained as impurities, the effects of these optional elements are not impaired.

(Cr: 0% or More and 1.0% or Less)

Cr is an element that improves the hardenability. It is thought that, if the amount thereof exceeds 1.0%, carbides present after hot rolling, after cold rolling, or after annealing (including after plating) are stabilized, dissolution by heating with hot stamping is delayed, and the hardenability deteriorates. Therefore, the upper limit of Cr is set to 1.0%. The lower limit is not particularly limited because it is possible to secure the hardenability required for hot stamping by adding an element that provides hardenability such as Mn, Mo, and Ni. The amount of Cr added is more preferably 0.05% or more and more preferably 1.0% or less.

(Mo: 0% or More and 1.0% or Less)

Mo is an element that improves the hardenability. It is thought that, if the amount thereof exceeds 1.0%, carbides present after hot rolling, after cold rolling, or after annealing (including after plating) are stabilized, dissolution by heating with hot stamping is delayed, and the hardenability deteriorates. Therefore, the upper limit of Mo is set to 1.0%. The lower limit is not particularly limited because it is possible to secure the hardenability required for hot stamping by adding an element that provides hardenability such as Mn and Ni. The amount of Mo added is more preferably 0.05% or more and more preferably 0.5% or less.

(Ca: 0% or More and 0.0010% or Less)

It is desirable not to add Ca in order to inhibit generation of $CaO—Al_2O_3$ which becomes a starting point of hydrogen embrittlement cracks. However, even if Ca is not added, it may be mixed in from a ladle slag during smelting or from powder used during casting. Therefore, it is necessary to minimize this mixing in, and the upper limit value of Ca is limited to 0.0010%. Within this range, a likelihood of generating coarse $CaO—Al_2O_3$ that becomes a starting point of hydrogen embrittlement cracks is low. However, depending on refining conditions, $CaO—Al_2O_3$ present in a small amount may aggregate and coarsen, and it is important to use a refining method for preventing coarsening.

(B: 0.0005% or More and 0.01% or Less)

B is added in order to improve the hardenability in cooling during press forming or after press forming, and in order to exhibit this effect, it is necessary to add an amount of 0.0005% or more. However, if the amount added unnecessarily increases, there is a concern of cracking during heating, and the effect becomes maximized, and thus the upper limit of B is preferably 0.01%.

(Ti: 0.5% or Less, Nb: 0.5% or Less, V: 0.5% or Less, and Zr: 0.5% or Less)

Ti, Nb, V, and Zr are added for fixing N that forms a compound with B in order to effectively exhibit the effect of B. Ti, Nb, V, and Zr also have an effect of improving the toughness and hydrogen embrittlement resistance by forming carbides and nitrides, and of restricting grain growth of austenite during heating to make them finer. However, since excessive addition deteriorates toughness, the upper limit of amounts of these elements added is set to 0.5%. The amounts of these elements added are each 0.005% or more in consideration of the amounts added required to exhibit the effect.

(N: 0.02% or Less)

If the amount of N exceeds 0.02%, the toughness tends to deteriorate because of coarsening of nitrides. Therefore, the amount of N is preferably set to 0.02% or less. The amount of N is more preferably 0.01% or less.

(Ni+Cu+Sn: 0% or More and 2% or Less)

The hot-stamped member according to the first embodiment may contain, in mass %, Ni+Cu+Sn (a total amount of Ni, Cu, and Sn): 0% or more and 2% or less, in a chemical composition.

When the elements Ni, Cu, and Sn are added, plating adhesion can be improved. In addition, improvement in corrosion resistance can be expected. In order to obtain these effects, it is preferable to add a total amount of 0.005% or more of Ni, Cu, and Sn. However, since excessive addition increases the alloy cost, the upper limit of the sum of the amounts of these elements added is set to 2%. More preferably, the upper limit value of the total amount of Ni+Cu+Sn is 1.0%, and the lower limit value thereof is 0.05%.

Mg, Y, As, Sb, and REM may be added because it is thought that they change the shape of MnS, which is a main sulfide, and improve impact characteristics and delayed fracture characteristics. However, since excessive addition deteriorates the processability, the upper limit thereof is desirably 0.1% or less.

In addition, even if an element not specified above such as Se or W is contained as another element, there is no major problem in characteristics as long as the amount thereof appropriately does not exceed 0.1%.

O is not particularly restricted, but the content of O is desirably 0.015% or less because excessive addition causes generation of oxides that adversely influence the toughness, and causes generation of oxides that become starting points of fatigue fracture. Here, the hot-stamped member according to the present embodiment contains impurities. Here, "impurities" are those that are mixed in from ore or scrap as a raw material when steel is industrially produced or from a production environment and the like. Among these impurities, the amounts of P, S, O, and N are preferably limited as described above. In addition, since the content of impurities is preferably small, it is not necessary to limit the lower limit value, and the lower limit value of impurities may be 0%.

Next, characteristics of inclusions in the hot-stamped member according to the first embodiment will be described.

$CaO—Al_2O_3$ is an inclusion that becomes a starting point in hydrogen embrittlement cracks that occur in a tensile test when a certain amount of hydrogen or more is contained. This is confirmed by observing the fracture surface of the test piece according to the tensile test.

In addition, it is thought that TiN and the like are present as coarse inclusions, but according to studies by the inventors, no case in which hydrogen embrittlement cracks occurred with TiN and the like as starting points was observed. Therefore, it is speculated that $CaO—Al_2O_3$ has a characteristic that it becomes a starting point of hydrogen embrittlement cracks.

When $CaO—Al_2O_3$ contains a certain amount of hydrogen or more, the reason why it becomes a starting point of hydrogen embrittlement cracks generated in the tensile test is speculated as follows.

That is, based on the observation results of the fracture surface, it is speculated that $CaO—Al_2O_3$, which is considered to become a starting point, often has cracks and is more brittle than other precipitates and inclusions. Therefore, it is speculated that fracture is likely to occur when tensile stress is applied to the inclusions, and the fracture causes hydrogen embrittlement cracks of the steel material.

In addition, it is speculated that the stress applied to the inclusions depends on the major axis of the inclusions, larger stress is applied to an inclusion having a larger major axis, and the inclusion fractures and becomes a starting point of hydrogen embrittlement cracks.

That is, it is thought that the length of the major axis of the inclusions is important, and by limiting the length, it is possible to inhibit fracture of the inclusion and to inhibit hydrogen embrittlement cracks.

Here, when the major axis of the inclusions is 50 μm or less, since hydrogen embrittlement cracks do not occur, the major axis of the inclusions is preferably set to an upper limit of 50 μm. In addition, the major axis of the inclusions is more preferably 30 μm or less in order to reliably secure the above effect.

The major axis of the inclusions is obtained by observing the fracture surface of the test piece in which fracture occurs according to the tensile test under a scanning electron microscope (SEM). Since the inclusions present on the fracture surface broken in the tensile test are broken and do not remain at all in many cases, the iron dent present around the inclusions can be regarded as a part in which inclusions are present, and the length of this part can be regarded as the major axis of the inclusions.

In addition, if the thickness of the inclusion in a sheet thickness direction is small, the major axis can be set using a range in which the inclusions are clogged in the dent as the inclusion.

The major axis of the inclusions can be measured directly from images or pictures captured using an SEM.

Figure 2:
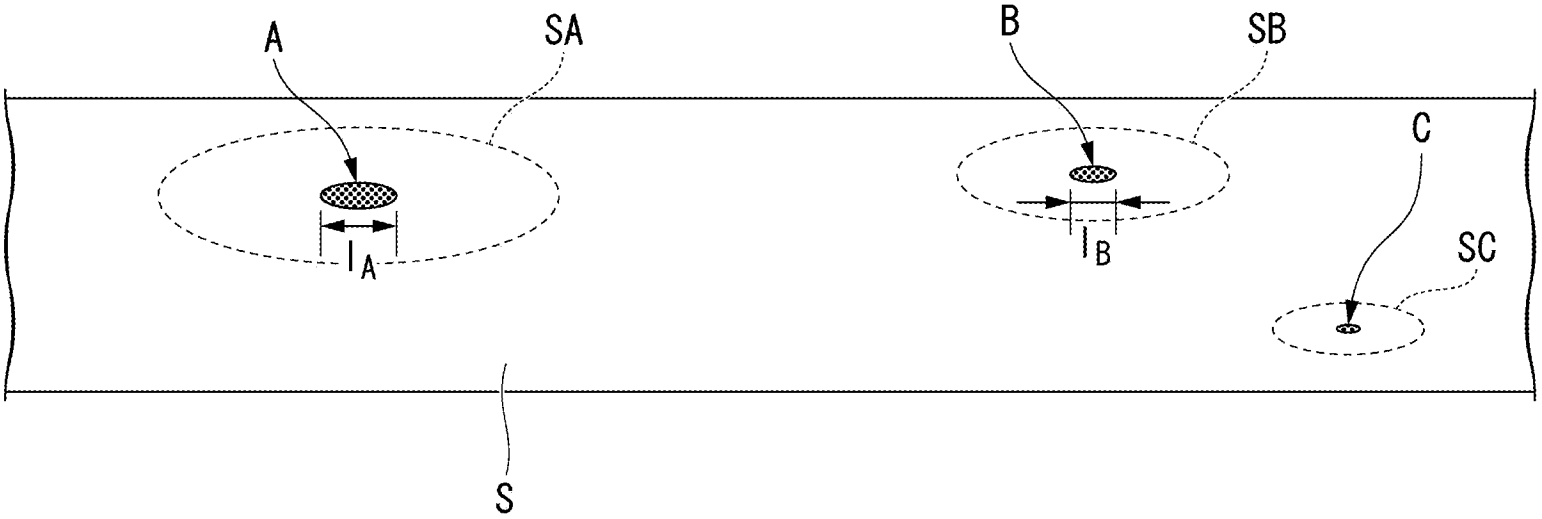
FIG. 2 is a schematic cross-sectional view for illustrating inclusions that become starting points of hydrogen embrittlement cracks.

FIG. 2 is a schematic cross-sectional view for illustrating inclusions that become starting points of hydrogen embrittlement cracks, and shows a cross section of a plane perpendicular to a rolled direction during production in a steel material S of a hot-stamped member.

The starting point of the fracture according to the tensile test is an inclusion at a center of a grain boundary fracture surface formed in an elliptical shape. When there are two or more elliptical grain boundary fracture surfaces, an inclusion having a longer major axis becomes a starting point of the fracture, and this major axis is set as a major axis of the inclusions. In the example of FIG. 2, an inclusion A is present at the center of a grain boundary fracture surface SA, an inclusion B is present at the center of a grain boundary fracture surface SB, and an inclusion C is present at the center of a grain boundary fracture surface SC.

In the example of FIG. 2, "(a major axis $1_A$ of the inclusion A)>(a major axis $1_B$ of the inclusion B)", and among the inclusions A to C, the major axis $1_A$ of the inclusion A is the longest. Therefore, it is determined that the inclusion A becomes a starting point of hydrogen embrittlement cracks, and if the major axis $1_A$ of the inclusion A is 50 μm or less, hydrogen embrittlement cracks do not occur.

In the hot-stamped member according to the first embodiment, the tensile strength measured using a tensile test piece of the hot-stamped member left in the air at a room temperature of 20 to 30° C. for 48 hours or longer exceeds 1,600 MPa.

When the hot-stamped member after quenching is left in the air at a room temperature of 20 to 30° C. for 48 hours or longer, a sufficient amount of hydrogen is released from the inside of the hot-stamped member.

It is preferable to collect the tensile test piece of the hot-stamped member from a flat part of the hot-stamped member because the accuracy of the tensile test result is secured.

In the hot-stamped member according to the first embodiment, the maximum length of the MnS present in the central part of the sheet thickness may be 300 μm or less. In the present embodiment, the central part of the sheet thickness means a range from the center of the sheet thickness to a thickness of ⅓ of the sheet thickness in the sheet thickness direction of the hot-stamped member. In addition, the maximum length of the MnS is more preferably 200 μm or less.

It is thought that, since the MnS is stretched longer during rolling, when stress is applied, stress concentration occurs at the end, which becomes a starting point of hydrogen embrittlement cracks. When the MnS becomes longer, stress generated at the end becomes larger, which promotes the occurrence of hydrogen embrittlement cracks. In addition, since the MnS is likely to occur in the central segregation part, the largest precipitate is present in the central part of the sheet thickness. Here, it is preferable to set the maximum length of the MnS present in the central part of the sheet thickness to 300 μm or less. The length of the MnS can be obtained by mirror-polishing a cross section of a target steel material in the rolling direction and observing MnS in the central part of the sheet thickness under a metal microscope at a magnification of 200 to 500. MnS can be confirmed by performing elemental analysis with SEM-EDS (EDS-mounted scanning electron microscope) or an electron probe micro analyzer (EPMA)). Here, it is desirable to perform observation in about 10 fields of view.

At the center part of the thickness of the slab during continuous casting, center segregation in which solute elements are concentrated macroscopically occurs. In the center segregation, the surrounding concentrated molten steel is collected in the center part because of a flow of a liquid phase generated by bulging, solidification shrinkage, and the like. In the central segregation part, solute elements are concentrated as compared with general solidification parts, and coarse MnS is likely to be generated even if the S concentration is low. In order to inhibit center segregation, a method in which pressure reduction in which a slab is depressurized to the extent that it compensates for solidification shrinkage is performed or a flow is caused in molten steel by electromagnetic stirring to cause equiaxed crystallization is known. In any of methods, it is possible to reduce center segregation, and it is possible to inhibit generation of coarse MnS. In addition, if the S concentration is reduced to 0.0030 mass % or less by performing such center segregation measurement, coarse MnS that causes a problem is hardly generated. In addition, if the S concentration can be reduced to 0.0010 mass % or less, the generation of MnS itself can be minimized.

In addition, the hot-stamped member according to the first embodiment may have a plating layer on the surface.

Aluminum plating, aluminum-zinc plating, or zinc plating may be applied to the steel sheet for the hot-stamped member as described above. Although the plating composition contains aluminum and zinc as main components, an element such as Ni may be added in order to improve characteristics. In addition, an element such as Fe may be contained as impurities.

Here, regarding a method of producing a steel sheet for the hot-stamped member described above, pickling and cold rolling may be performed by a general method, and the subsequent aluminum plating process, aluminum-zinc plating process, and zinc plating process may also be performed by a general method.

For aluminum plating, a Si concentration in a bath is suitably 5 to 12%, and for aluminum-zinc plating, a Zn concentration in a bath is suitably 40 to 50%.

In addition, even if Mg or Zn is mixed in the aluminum plating layer or Mg is mixed in the aluminum-zinc plating layer, it is possible to produce a steel sheet having the same characteristics without any particular problem.

Here, regarding the atmosphere in the plating process, it is possible to perform plating under general conditions in both a continuous plating facility including a non-oxidation furnace and a continuous plating facility including no non-oxidation furnace, and because no special control only for this steel sheet is required, the productivity is not impaired. In addition, any method such as hot-dip galvanizing, electrogalvanizing, and alloyed hot-dip galvanizing may be used as long as it is a zinc plating method.

In the above production conditions, metal pre-plating is not performed on the surface of the steel sheet before plating, but there is no particular problem even if Ni pre-plating, Fe pre-plating, or other metal pre-plating for improving plating properties is performed. In addition, a plating of different types of metals or a film of an inorganic or organic compound may be applied to the surface of the plating layer.

Second Embodiment

A hot-stamped member according to a second embodiment is a hot-stamped member having a chemical composition including, in mass %, C: 0.25% or more and 0.55% or less,
Si: 0.001% or more and 2.0% or less,
Mn: 0.3% or more and 3.0% or less,
P: 0.02% or less,
S: 0.003% or less,
Al: 0.005% or more and 1.0% or less,
Cr: 0% or more and 1.0% or less,
Mo: 0% or more and 1.0% or less,
N: 0.02% or less,
Ca: 0% or more and 0.0010% or less,
B: 0.0005% or more and 0.01% or less,
one or two or more selected from the group consisting of Ti: 0.005% or more and 0.5% or less, Nb: 0.005% or more and 0.5% or less, V: 0.005% or more and 0.5% or less, and Zr: 0.005% or more and 0.5% or less,
Ni+Cu+Sn: 0% or more and 2% or less, and
a remainder consisting of Fe and impurities.

In the hot-stamped member according to the second embodiment, the tensile strength of the hot-stamped member left in the air at a room temperature of 20 to 30° C. for 48 hours or longer exceeds 1,600 MPa, and when the uniform elongation is $El_1$ (%) and the total elongation measured using a tensile test piece of the hot-stamped member charged with hydrogen so that the amount of diffusible hydrogen is 0.5±0.1 wt. ppm is $El_2$ (%), $(El_2/El_1)\times100\geq100$(%) is satisfied.

The chemical composition of the hot-stamped member according to the second embodiment is the same as that of the hot-stamped member according to the first embodiment.

Like the hot-stamped member according to the first embodiment, in the hot-stamped member according to the second embodiment, the tensile strength measured using a tensile test piece of the hot-stamped member left in the air at a room temperature of 20 to 30° C. for 48 hours or longer exceeds 1,600 MPa, and the uniform elongation is $El_1$(%).

In addition, in the hot-stamped member according to the second embodiment, when the total elongation measured using a tensile test piece of the hot-stamped member charged with hydrogen so that the amount of diffusible hydrogen is 0.5±0.1 wt. ppm is $El_2$ (%), $(El_2/El_1)\times100\geq100$(%) is satisfied.

When there are coarse inclusions containing $CaO—Al_2O_3$ inside the tensile test piece, hydrogen acts to cause hydrogen embrittlement. When a tensile test is performed on the tensile test piece in which hydrogen embrittlement has occurred, the tensile test piece does not undergo sufficient plastic deformation, and breaks brittlely before the original tensile strength is reached. As a result, the elongation has a small numerical value.

The original tensile properties (tensile strength and elongation) can be confirmed by performing the tensile test using a tensile test piece in which hydrogen is released.

In determining the quality of the hot-stamped member, if the elongation ratio, that is, $(El_2/El_1)\times100$, is 100% or more, hydrogen embrittlement does not occur. Originally, two elongations should be compared between the same uniform elongations, but the tensile test piece charged with hydrogen often breaks early before the maximum tensile load is reached, and thus it is difficult to accurately measure the uniform elongation. Therefore, instead of the uniform elongation, the total elongation measured after fracture (breaking elongation) is measured and evaluated.

The evaluation based on such total elongation is stricter than the evaluation based on uniform elongation.

In the hot-stamped member according to the second embodiment, the tensile properties are measured using a tensile test piece of the hot-stamped member in a general state in which hydrogen is released and a tensile test piece of the hot-stamped member charged with hydrogen so that the amount of diffusible hydrogen is 0.4 to 0.6 wt. ppm (0.5±0.1 wt. ppm).

The amount of diffusible hydrogen can be measured by a thermal desorption method.

Third Embodiment

A steel sheet for hot stamping according to a third embodiment is a steel sheet for hot stamping having a chemical composition including, in mass %, C: 0.25% or more and 0.55% or less,
Si: 0.001% or more and 2.0% or less,
Mn: 0.3% or more and 3.0% or less,
P: 0.02% or less,
S: 0.003% or less,
Al: 0.005% or more and 1.0% or less,
Cr: 0% or more and 1.0% or less,
Mo: 0% or more and 1.0% or less,
N: 0.02% or less,
Ca: 0% or more and 0.0010% or less,
B: 0.0005% or more and 0.01% or less,
one or two or more selected from the group consisting of Ti: 0.005% or more and 0.5% or less, Nb: 0.005% or more and 0.5% or less, V: 0.005% or more and 0.5% or less, and Zr: 0.005% or more and 0.5% or less,
Ni+Cu+Sn: 0% or more and 2% or less, and
a remainder consisting of Fe and impurities.

In the steel sheet for hot stamping according to the third embodiment, the tensile strength measured using a tensile test piece obtained by heating the steel sheet for hot stamping at 950° C. for 1 minute and then cooling to 200° C. or lower at an average cooling rate of 30 to 100° C./s, the steel sheet for hot stamping being left in the air at a room temperature of 20 to 30° C. for 48 hours or longer, exceeds 1,600 MPa, and the major axis of inclusions containing $CaO—Al_2O_3$ contained in the hot-stamped member is 50 μm or less.

The chemical composition of the steel sheet for hot stamping according to the third embodiment is the same as that of the hot-stamped member according to the first embodiment.

In the steel sheet for hot stamping according to the third embodiment, the tensile strength measured using a tensile test piece obtained by heating the steel sheet for hot stamping at 950° C. for 1 minute and then cooling to 200° C. or lower at an average cooling rate of 30 to 100° C./s, the steel sheet for hot stamping being left in the air at a room temperature of 20 to 30° C. for 48 hours or longer, exceeds 1,600 MPa. Even if the steel sheet for hot stamping is not hot-stamped intentionally, if a tensile test is performed by performing heating and quenching under the above conditions, the strength level and hydrogen embrittlement resistance characteristics when the sheet is processed into a hot-stamped member can be predicted and evaluated in a simulated manner.

Like the hot-stamped member according to the first embodiment, in the steel sheet for hot stamping according to the third embodiment, the major axis of inclusions containing $CaO—Al_2O_3$ contained in the hot stamp steel sheet is 50 μm or less.

Fourth Embodiment

A steel sheet for hot stamping according to a fourth embodiment is a steel sheet for hot stamping having a chemical composition including, in mass %, C: 0.25% or more and 0.55% or less,
Si: 0.001% or more and 2.0% or less,
Mn: 0.3% or more and 3.0% or less,
P: 0.02% or less,
S: 0.003% or less,
Al: 0.005% or more and 1.0% or less,
Cr: 0% or more and 1.0% or less,
Mo: 0% or more and 1.0% or less,
N: 0.02% or less,
Ca: 0% or more and 0.0010% or less,
B: 0.0005% or more and 0.01% or less,
one or two or more selected from the group consisting of Ti: 0.005% or more and 0.5% or less, Nb: 0.005% or more and 0.5% or less, V: 0.005% or more and 0.5% or less, and Zr: 0.005% or more and 0.5% or less,
Ni+Cu+Sn: 0% or more and 2% or less, and
a remainder consisting of Fe and impurities.

In the steel sheet for hot stamping according to the fourth embodiment, the tensile strength measured using a tensile test piece obtained by heating the steel sheet for hot stamping at 950° C. for 1 minute and then cooling to 200° C. or lower at an average cooling rate of 30 to 100° C./s, the steel sheet for hot stamping being left in the air at a room temperature of 20 to 30° C. for 48 hours or longer, exceeds 1,600 MPa, and when the uniform elongation is $El_3$ (%) and the total elongation measured using the tensile test piece charged with hydrogen so that the amount of diffusible hydrogen is 0.5±0.1 wt. ppm is $El_4$ (%), $(El_4/El_3)\times100\geq100$ (%) is satisfied.

The chemical composition of the steel sheet for hot stamping according to the fourth embodiment is the same as that of the hot-stamped member according to the first embodiment.

Like the hot-stamped member according to the first embodiment, in the steel sheet for hot stamping according to the fourth embodiment, the tensile strength measured using a tensile test piece of the hot-stamped member left in the air at a room temperature of 20 to 30° C. for 48 hours or longer exceeds 1,600 MPa, and the uniform elongation is $El_3$ (%).

In addition, like the hot-stamped member according to the second embodiment, in the steel sheet for hot stamping according to the fourth embodiment, when the total elongation measured using a tensile test piece of the hot-stamped member charged with hydrogen so that the amount of diffusible hydrogen is 0.5±0.1 wt. ppm is $El_4$ (%), $(El_4/El_3)\times 100\geq 100(\%)$ is satisfied.

When there are coarse inclusions containing CaO—$Al_2O_3$ inside the tensile test piece, hydrogen acts to cause hydrogen embrittlement. When a tensile test is performed on the tensile test piece in which hydrogen embrittlement has occurred, the tensile test piece does not undergo sufficient plastic deformation, and breaks brittlely before the original tensile strength is reached. As a result, the elongation has a small numerical value.

The original tensile properties (tensile strength and elongation) can be confirmed by performing the tensile test using a tensile test piece in which hydrogen is released.

In determining the quality of the steel sheet for hot stamping, a heating and quenching treatment corresponding to hot stamp forming is performed in a simulated manner, and the tensile test is performed on a hydrogen-released or hydrogen-charged tensile test piece. If the elongation ratio, that is, $(El_4/El_3)\times 100$, is 100% or more, hydrogen embrittlement does not occur.

Originally, two elongations should be compared between the same uniform elongations, but the tensile test piece charged with hydrogen often breaks early before the maximum tensile load is reached, and thus it is difficult to accurately measure the uniform elongation. Therefore, instead of the uniform elongation, the total elongation measured after fracture (breaking elongation) is measured and evaluated.

The evaluation based on such total elongation is stricter than the evaluation based on uniform elongation.

Fifth Embodiment

As a method of producing the hot-stamped member according to the first embodiment or the second embodiment and the steel sheet for hot stamping according to the third embodiment or the fourth embodiment, a method in which ladle refining is performed on molten steel discharged from a converter in a ladle refining facility (ladle furnace (LF)), vacuum degassing refining is then performed in a vacuum degassing device (DH, RH, etc.), and casting is additionally performed can be preferably used.

In order to produce a steel sheet for hot stamping and a hot-stamped member which have a desired tensile strength and which can prevent hydrogen embrittlement cracks, it is required to make high-cleanliness steel in which the number of non-metal inclusions in the steel during refining is reduced as much as possible. After oxygen is injected into the molten steel in the converter and decarburization refining is completed, a deoxidizing agent such as aluminum (Al) is added in order to remove excess oxygen in the molten steel. In this case, the non-metal inclusions immediately after deoxidation are basically $Al_2O_3$. On the other hand, calcium (Ca), calcium oxide (CaO), and the like are continuously added in order to remove sulfur (S) that adversely influences characteristics of steel. As a result, it is known that Ca or CaO reacts with $Al_2O_3$ to form a CaO—$Al_2O_3$ inclusion.

The desulfurization effect and the amount of CaO—$Al_2O_3$ inclusions generated depend on a method of adding Ca or CaO to the molten steel. As the method of adding Ca or the like performed in secondary refining after the converter operation, the following three types are mainly exemplified.

(1) Method of Adding Metallic Ca to Molten Steel

In order to control the morphology of inclusions, for example, in order to make sulfides into spherical CaS inclusions, there is provided a method of directly adding the metallic Ca to the molten steel during refining in a vacuum degassing device (DH, RH, etc.). In this case, a risk of producing a large amount of CaO—$Al_2O_3$ inclusions is higher than that of the method described below. Therefore, this method cannot be preferably used.

(2) Method of Injecting Desulfurizing Agent Containing CaO as Main Component into Molten Steel When a desulfurizing agent containing CaO as a main component is injected into the molten steel, if the entire desulfurizing agent is absorbed by the slag side and removed from the molten steel, the cleanliness of the steel is maintained and there is no problem. However, actually, a part of the desulfurizing agent remains in the molten steel, and CaO—$Al_2O_3$ inclusions are generated by combining with $Al_2O_3$ in the molten steel and the reaction with Al. The risk of producing a large amount of CaO—$Al_2O_3$ inclusions is the same as or slightly lower than that of the above method of adding the metallic Ca. Therefore, this method cannot be preferably used either.

(3) Method of Adding Flux or Slag Containing CaO to Slag

When slag refining is performed using an LF, there is a method of adding a CaO flux or CaO-containing slag into the slag instead of the molten steel in order to control the slag composition. When the CaO concentration ((CaO(mass %))/($Al_2O_3$(mass %)) of the slag composition) in the slag is high, the desulfurization reaction proceeds, which is advantageous. On the other hand, when the CaO concentration becomes too high, due to the reaction between the slag and the metal (molten steel), a small amount of Ca components is dissolved in the molten steel, and CaO—$Al_2O_3$ inclusions are generated.

In the case of the above method (3), it is preferable to set the CaO concentration ((CaO(mass %))/($Al_2O_3$(mass %)) of the slag composition) in the slag to a low value (1.0 to 1.5). However, there is a likelihood of coarse CaO—$Al_2O_3$ inclusions being generated because of fluctuations in the operation.

Here, in the method according to the present embodiment, in the first half of the LF treatment, in consideration of the slag-making property and the desulfurization reaction, (CaO (mass %))/($Al_2O_3$ (mass %)) of the slag composition is controlled to be within a range of 1.0 to 1.5, and in the second half of the LF treatment, in order to reduce the amount of CaO—$Al_2O_3$ inclusions, (CaO(mass %))/($Al_2O_3$ (mass %)) is set to be within a range of 0.7 to 1.1, and thus the CaO concentration in the second half of the LF treatment may be controlled so that it is lower than the CaO concentration in the first half of the LF treatment. If this method is used, both desulfurization and reduction of the amount of CaO—$Al_2O_3$ inclusions can be achieved in a well-balanced manner.

In order to reduce the production cost, preferably, in the first half of the LF treatment, (CaO(mass %))/($Al_2O_3$ (mass %)) of the slag composition is set to more than 1.1 to 1.2, and in the second half of the LF treatment (CaO(mass %))/($Al_2O_3$ (mass %)) of the slag composition is set to 1.0 to less than 1.1. More preferably, in the first half of the LF treatment, (CaO(mass %))/($Al_2O_3$(mass %)) of the slag composition is set to more than 1.0 to 1.2, and in the second half of the LF treatment, (CaO(mass %))/($Al_2O_3$(mass %)) of the slag composition is set to 0.9 to less than 1.0. Still more preferably, in the first half of the LF treatment, (CaO(mass %))/($Al_2O_3$ (mass %)) of the slag composition is set to 1.2 to 1.5, and in the second half of the LF treatment, (CaO(mass %))/($Al_2O_3$(mass %)) of the slag composition is set to 0.7 to 0.9.

Here, the first half of the LF treatment can be defined as a desulfurization period (until the S concentration becomes less than 0.003 mass %). In addition, the second half of the LF treatment can be defined as a stirring period (for improving cleanliness such as floating removal of non-metal inclusions) following the desulfurization period. In addition, the CaO concentration ((CaO(mass %))/($Al_2O_3$ (mass %)) of the slag composition) can be measured by a fluorescent X-ray method.

That is, the hot-stamped member according to the first embodiment or the second embodiment and the steel sheet for hot stamping according to the third embodiment or the fourth embodiment is subjected to slag refining using LF, and in order to control the slag composition, a CaO flux or CaO-containing slag is added into the slag instead of the molten steel, and in the first half of the LF treatment, (CaO(mass %))/($Al_2O_3$ (mass %)) of the slag composition is controlled to be within a range of 1.0 to 1.5, and in the second half of the LF treatment, in order to reduce the amount of CaO—$Al_2O_3$ inclusions, (CaO(mass %))/($Al_2O_3$ (mass %)) is controlled to be within a range of 0.7 to 1.1 (preferably, in the first half of the LF treatment, (CaO(mass %))/($Al_2O_3$ (mass %)) of the slag composition is set to more than 1.1 to 1.2, in the second half of the LF treatment, (CaO(mass %))/($Al_2O_3$ (mass %)) of the slag composition is set to 1.0 to less than 1.1, in the first half of the LF treatment, (CaO(mass %))/($Al_2O_3$(mass %)) of the slag composition is set to more than 1.0 to 1.2, and in the second half of the LF treatment, (CaO(mass %))/($Al_2O_3$(mass %)) of the slag composition is set to 0.9 to less than 1.0, and more preferably, in the first half of the LF treatment, (CaO(mass %))/($Al_2O_3$ (mass %)) of the slag composition is set to 1.2 to 1.5, and in the second half of the LF treatment, (CaO(mass %))/($Al_2O_3$ (mass %)) of the slag composition is set to 0.7 to 0.9 in the second half), and thus desired characteristics can be obtained.

The time from the end of secondary refining to the start of casting is preferably in a range of 20 to 120 minutes. If the time exceeds 120 minutes, since aggregation and coarsening of inclusions proceed remarkably, the time is preferably 120 minutes or less. On the other hand, it is operationally and technically difficult to start casting in less than 20 minutes.

In the production method according to the present embodiment, after the secondary refining, a slab is produced by casting. For the casting, continuous casting, which is generally used, can be used.

Then, preferably, the produced slab is heated to 1,000 to 1,400° C., and is subjected to hot rolling to obtain a hot-rolled steel sheet having a sheet thickness of 1.5 to 6.0 mm with a finishing temperature of 800 to 1,000° C. and a winding temperature of 300 to 800° C. Then, preferably, cold rolling or hot rolling is performed at a rolling reduction ratio of 30 to 85% to obtain a rolled steel sheet. The rolled steel sheet may be subjected to a surface treatment such as the above plating treatment.

According to the above procedure, the steel sheet for hot stamping according to the third embodiment or the fourth embodiment may be obtained.

Then, the rolled steel sheet or the surface-treated steel sheet is preferably heated to an $Ac_3$ transformation temperature or higher. The heating conditions are preferably maintained at a temperature of 850 to 1,000° C. for a time of 10 seconds to 20 minutes.

Then, in a stamp device (press machine) having a cooling function such as a water-cooled mold, preferably, quenching is performed at the same time as forming to obtain a hot-stamped member. For quenching conditions, stamping (pressing) starts at an Ara transformation temperature or higher, a surface pressure of 3 MPa or more, more preferably, a load of 10 MPa or more, is applied in the mold, the bottom dead center is maintained for 3 to 30 seconds, and preferably, cooling is completed until the temperature is a martensitic transformation completion temperature or lower, and preferably 200° C. or lower.

EXAMPLES

Hereinafter, hot-stamped members and steel sheets for hot stamping of the present invention will be described in detail with reference to examples. The following examples are simply examples of the present invention, and the hot-stamped members and the steel sheets for hot stamping of the present invention are not limited to the following examples.

Example 1

In order to appropriately control inclusions in the chemical components (mass %, with the remainder consisting of Fe and impurities) of steel types Nos. 1 to 4 shown in Table 1, the following three types of secondary refining methods A, B, and C were performed, and the results thereof were compared.

Here, "–" in Table 1 or Table 3 means that the content of these elements is less than the detection limit. In addition, depending on the refining method, the content of S was changed in a range of 0.0004 to 0.0015 mass %, and the content of Ca was changed in a range of 0.0001 to 0.0008 mass %, which was a change derived from the secondary refining method. For S and Ca in Table 1, the results obtained by a secondary refining method A are shown.

In the secondary refining method A, (CaO(mass %)/$Al_2O_3$ (mass %)) of a slag was adjusted in the first half and the second half of the treatment in order to control desulfurization and inclusion compositions using a conduction type ladle refining furnace (LF).

In the secondary refining method A, first, after desulfurization was performed with a slag of (CaO(mass %)/$Al_2O_3$ (mass %))=1.0 to 1.5 in the slag, (CaO(mass %)/$Al_2O_3$ (mass %)) in the slag was controlled to be within a range of 0.7 to 1.1 in order to reduce the amount of inclusions containing CaO—$Al_2O_3$ generated.

In a secondary refining method B, desulfurization was performed using the LF with the same slag as above at a certain value of (CaO(mass %)/$Al_2O_3$ (mass %))=1.0 to 1.5.

In a secondary refining method C, a desulfurizing agent containing CaO as a main component was injected into the molten steel together with an inert gas using an injection type ladle refining furnace, and desulfurization was performed. The basic unit of the desulfurizing agent used in this case was 2.0 to 5.0 kg/steel-ton.

TABLE 1

| Steel type No. | C | Si | Mn | P | S | Al | Cr | Mo | N | Ca | B |
|---|---|---|---|---|---|---|---|---|---|---|---|
| 1 | 0.273 | 0.480 | 1.42 | 0.008 | 0.0013 | 0.052 | 0.240 | 0.11 | 0.0042 | 0.0002 | 0.0025 |
| 2 | 0.312 | 0.230 | 1.34 | 0.012 | 0.0004 | 0.040 | 0.380 | — | 0.0054 | 0.0001 | 0.0023 |
| 3 | 0.347 | 0.520 | 0.73 | 0.011 | 0.0009 | 0.044 | 0.110 | 0.23 | 0.0058 | 0.0000 | 0.0019 |
| 4 | 0.443 | 0.330 | 0.45 | 0.011 | 0.0008 | 0.044 | 0.120 | 0.28 | 0.0035 | 0.0002 | 0.0021 |

| Steel type No. | Ti | Nb | V | Zr | Ni | Cu | Sn | Ni + Cu + Sn |
|---|---|---|---|---|---|---|---|---|
| 1 | 0.0430 | — | 0.0450 | — | — | — | — | — |
| 2 | 0.0350 | 0.0530 | — | — | 0.011 | 0.012 | 0.002 | 0.025 |
| 3 | 0.0280 | 0.0510 | — | 0.0100 | — | — | — | — |
| 4 | 0.0390 | 0.0680 | — | — | 0.120 | 0.230 | 0.120 | 0.470 |

In Table 2, secondary refining methods are described with symbols A, B and C. The steel type No. in Table 2 corresponds to the steel type No. in Table 1.

TABLE 2

| Experiment No. | Steel No. type | Secondary refining method | Surface treatment | Tensile strength (MPa) | Uniform elongation $El_1$ (%) | Total elongation after hydrogen charging $El_2$ (%) | $El_2/El_1 \times 100$ | Tensile after hydrogen charging | Analysis results of inclusion composition Ca | Al | O | Other | Major axis of inclusion containing CaO/$Al_2O_3$ (μm) | MnS length (μm) | Category |
|---|---|---|---|---|---|---|---|---|---|---|---|---|---|---|---|
| 1 | 1 | A | GA | 1792 | 5.1 | 8.1 | 159% | O | — | — | — | — | — | 72 | Example |
| 2 | 1 | B | GA | 1732 | 5.3 | 3.1 | 58% | X | O | O | O | S, Si, Fe, C | 61 | 32 | Comparative Example |
| 3 | 1 | C | GA | 1745 | 5.0 | 2.3 | 46% | X | O | O | O | S, Si, Fe, C | 93 | 0 | Comparative Example |
| 4 | 2 | A | AL | 1892 | 5.1 | 7.8 | 153% | O | — | — | — | — | — | 0 | Example |
| 5 | 2 | B | AL | 1931 | 4.9 | 2.8 | 57% | X | O | O | O | S, Fe, | 58 | 0 | Comparative Example |
| 6 | 2 | C | AL | 1905 | 4.9 | 1.9 | 39% | X | O | O | O | S, Si, Fe, C | 123 | 0 | Comparative Example |
| 7 | 3 | A | AL | 2045 | 5.1 | 7.1 | 139% | O | — | — | — | — | — | 42 | Example |
| 8 | 3 | B | AL | 2032 | 5.0 | 2.8 | 56% | X | O | O | O | S, Si, Fe, C | 79 | 12 | Comparative Example |
| 9 | 3 | C | AL | 2190 | 4.9 | 1.8 | 37% | X | O | O | O | S, Si, Fe, C | 122 | 0 | Comparative Example |
| 10 | 4 | A | CR | 2492 | 4.8 | 7.3 | 152% | O | — | — | — | — | — | 50 | Example |
| 11 | 4 | B | CR | 2513 | 4.9 | 3.5 | 71% | X | O | O | O | S, Fe, | 53 | 0 | Comparative Example |
| 12 | 4 | C | CR | 2532 | 4.8 | 2.3 | 48% | X | O | O | O | S, Si, Fe, C | 112 | 0 | Comparative Example |

After the secondary refining, a slab having chemical components shown in Table 1 (mass %, with the remainder consisting of Fe and impurities) was produced by continuous casting. For the casting, casting was performed in a vertical curved continuous casting machine (vertical part: 2.5 m) in a casting speed range of 1.0 to 1.2 m/min. In addition, the time from the end of secondary refining to the start of casting was in a range of 20 to 120 minutes.

Each of the produced slabs was heated to 1,050 to 1,350° C. and hot-rolled to obtain a hot-rolled steel sheet having a sheet thickness of 3.3 mm with a finishing temperature of 830 to 900° C. and a winding temperature of 450 to 730° C. Then, cold rolling was performed at a sheet thickness of 1.6 mm to obtain a cold-rolled steel sheet.

In addition, hot-dip aluminum plating or alloyed hot-dip galvanizing was performed on the cold-rolled steel sheets of Experiment Nos. 1 to 9.

In the item of "surface treatment" in Table 2, GA indicates an experiment example in which alloyed hot-dip galvanizing was performed, AL indicates an experiment example in which hot-dip aluminum plating was performed, and CR indicates an experiment example of a cold-rolled steel sheet in which no plating treatment was performed.

Then, these cold-rolled steel sheets and surface-treated steel sheets were heated to an austenite region of 950° C. having an $Ac_3$ point or more by furnace-heating, and then quenched from 900° C. having an $Ac_3$ point or more by a press machine having a water-cooled mold. The shape of the mold was set as a flat sheet shape in order to evaluate characteristics after quenching. The bottom dead center holding time was set to 10 seconds, and cooling was performed with the mold. The temperature after cooling was 200° C. or lower.

Then, a part was cut out from the formed product formed by the above hot stamping method to prepare a tensile test piece.

In the case of a sample material having a plating layer, the plating layer was removed by chemical treatment or mechanical grinding before the tensile test piece was collected.

In the case of aluminum plating, the sample was immersed in 20% caustic soda for 24 hours, and then was immersed in a solution in which an inhibitor (Hibiron commercially available from SUGIMURA Chemical Industrial Co., Ltd.) for preventing dissolution of iron was added in 18% hydrochloric acid for 3 hours, and the pickling residue generated on the surface was removed.

In the case of zinc plating, the sample was immersed in a solution in which an inhibitor (Hibiron commercially available from SUGIMURA Chemical Industrial Co., Ltd.) for preventing dissolution of Fe was added in 5% hydrochloric acid for 24 hours, and the plating was removed. In the case of mechanical grinding, the plating layer was removed using a milling cutter or the like.

A collection direction of the tensile test piece was a direction perpendicular to the rolling direction of the steel material, and the shape was a shape of a JIS No. 5 tensile test piece. In this example, since hot stamp forming was performed with a flat plate mold, it was possible to collect the JIS No. 5 tensile test piece, but it may not be possible to collect it with the actual part shape. In this case, the shape of the tensile test piece that can be collected may be used.

Here, it is desirable that the shape of the tensile test piece be the test piece described in JIS or ISO if possible, but if it is not possible to collect the shape thereof, a shape different from the specification may be used.

Then, the test pieces were evaluated as follows.

(Tensile Strength)

First, the tensile strength of the test piece after quenching was determined by the tensile test according to JIS Z 2241 (2011). The JIS No. 5 test piece was used as the test piece, and the crosshead displacement speed was fixed at 2 mm/min. Other conditions were set in the method described in JIS Z 2241 (2011). Before the test was performed, the sample was left in the air at a room temperature of 20 to 30° C. for 48 hours or longer, and hydrogen was released. When a tensile strength of 1,600 MPa or more was obtained in the tensile test, it was evaluated to be good.

(Hydrogen Embrittlement)

Next, hydrogen embrittlement was evaluated.

In 3% saline+ammonium thiocyanate (3 g/l), the tensile test piece to be evaluated was charged with hydrogen as a negative electrode. Then, electrogalvanizing was performed on both sides of the test piece so that the thickness of one side was 10 μm, and release of hydrogen was limited. For hydrogen introduced by hydrogen charging, the amount of diffusible hydrogen was 0.5±0.1 wt. ppm.

The amount of diffusible hydrogen was measured using a thermal desorption method under the following conditions. Here, when a sample material having a plating layer was evaluated, according to the above method, the plating layer was removed by chemical treatment or mechanical grinding before the tensile test piece was collected.

The sample in which hydrogen was to be measured was ultrasonically washed in acetone for 120 seconds, and then placed in a silica tube installed in a small heating furnace, and heated, and released hydrogen was measured through gas chromatography using Ar as a carrier gas.

The temperature rise rate was 100° C./hour, and sampling was performed for 5 minutes/time. The cumulative amount of hydrogen released up to 250° C. in this measurement was defined as diffusible hydrogen. This measurement was performed using JTF-20A (commercially available from J-Science Lab Co., Ltd.).

The tensile test piece charged with hydrogen was subjected to a tensile test at a tensile speed of 2 mm/min, and it was checked whether fracture occurred because of hydrogen embrittlement before the tensile strength was obtained. The sample that did not fracture was evaluated as good. The tensile test was performed on five pieces, a piece with zero fractures was evaluated as "Good (○)", and a piece with one or more fractures was evaluated as "Bad (×)".

When fracture occurred, the fracture surface of the test piece was observed under an SEM. The starting point of the fracture was the center of the grain boundary fracture surface formed in an elliptical shape. When there were two or more elliptical grain boundary fracture surfaces, an inclusion having a longer major axis was determined as the starting point.

For example, in the example of FIG. 2, it was determined that the inclusion of A having the longest major axis $1_A$ of the inclusion was the starting point.

Then, the composition of the inclusion present at the starting point of the fracture was analyzed by Energy Dispersive X-ray Spectroscopy (EDS) or EPMA. It was confirmed that the composition contained Ca, Al, and O, and contained CaO—$Al_2O_3$. Here, it was confirmed that the composition contained Ca and Al in a weight ratio of 1% or more, and contained 5% or more of O. In addition, other elements were also confirmed.

Here, in the composition analysis result of the inclusions present at the starting point of the fracture in Table 2 or Table 4, those containing 1% or more of Ca, Al, or O were marked with "○", and those containing less than 1% of Ca, Al, or O or containing an undetectable amount thereof were marked with "–".

Here, in observation of the precipitate composition on the fracture surface, since a signal of the base iron (steel matrix) was contained in the composition of such Ca, Al, and O, the elements in the inclusions were often measured at a low level. Therefore, it can be evaluated with such a level of analysis value that elements were contained in the inclusions.

(Uniform Elongation and Total Elongation)

According to the method described in JIS Z 2241 (2011), for the test pieces, the uniform elongation $El_1$ and total elongation $El_2$ after hydrogen charging were measured to obtain $El_2/El_1$. If $(El_2/El_1)\times100$ was 100% or more, hydrogen embrittlement did not occur, which was a favorable result. Here, the total elongation and the uniform elongation were the breaking elongation and the maximum test power total elongation described in JIS Z 2241 (2011), respectively.

(Inclusion)

In addition, it was checked whether the major axis of the inclusion was more than 50 μm.

The major axis of the inclusions was measured as follows. First, the inclusions that become the starting points of hydrogen embrittlement cracks as described above were confirmed under an SEM. Since the inclusions present on the fracture surface were broken and did not remain at all in many cases, the iron dent present around the inclusions could be regarded as a part in which the inclusions were present, and the length (major axis) thereof was measured. If the thickness of the inclusion in the sheet thickness direction was small, the major axis thereof was measured using the range of the inclusion clogged in the dent as a size of the inclusion.

In Table 2 or Table 4, "–" indicates those in which the major axis of the inclusions could not be measured.

(MnS)

In addition, the length of MnS was measured by the following method.

The cross section of the steel material in the rolling direction was mirror-polished, the MnS at the central part of the sheet thickness was observed under a metal microscope at a magnification of 200 to 500, the length thereof was measured, and the longest one was recorded. Observation was performed in 10 or more fields of view. The central part of the sheet thickness was in a range from the center of the sheet thickness to the thickness of ⅓ of the sheet thickness.

In the steel material having chemical components of this example, the inclusions observed in such stretches were MnS. When the inclusion is confirmed as MnS, elemental analysis may be performed through SEM-EDS or EPMA. The MnS having a length up to 300 μm was evaluated as good. MnS may not be observed in this evaluation, and in this case, the length was described as 0 μm.

Table 2 shows the tensile strength, the fracture state in the tensile test after hydrogen charging, the composition and the major axis of the inclusions that became the starting points in observation of the fracture surface, and the length of the MnS together.

In Experiment Nos. 2, 5, 8, and 11 performed by the secondary refining method B, it was confirmed that fracture occurred in the tensile test after hydrogen charging, and inclusions having a major axis of 50 μm or more and containing CaO—$Al_2O_3$ were present as the starting points from observation of the fracture surface.

It is thought to be caused since (CaO(mass %)/$Al_2O_3$ (mass %)) of the slag was high during desulfurization using a conduction type ladle refining furnace (LF) in secondary refining, the amount of inclusions containing fine CaO—$Al_2O_3$ generated was large, and aggregation and coarsening occurred before casting.

It was confirmed that fracture occurred in the tensile test after hydrogen charging in Experiment Nos. 3, 6, 9, and 12 performed by the secondary refining method C, and the inclusions having a major axis of 50 μm or more and containing CaO—$Al_2O_3$ were present as the starting points from observation of the fracture surface.

It is thought that, since a desulfurizing agent containing CaO was injected into the steel in an injection type ladle refining furnace in secondary refining, the desulfurizing agent remained in the molten steel, and inclusions containing CaO—$Al_2O_3$ were generated.

In Experiment Nos. 1, 4, 7, and 10 performed by the secondary refining method A, no fracture occurred in the tensile test after hydrogen charging, the tensile strength and the size of MnS were within the range of the present invention, and a hot stamping part having excellent hydrogen embrittlement resistance could be realized.

In the secondary refining method A, regarding (CaO(mass %)/$Al_2O_3$ (mass %)) of the slag in the first half and the second half of the treatment using a conduction type ladle refining furnace (LF), the ratio in the second half was adjusted to be lower than in the first half in order to control desulfurization and the inclusion composition. It is thought that, when (CaO(mass %)/$Al_2O_3$(mass %)) of the slag in the second half of the secondary refining was lowered, the amount of inclusions containing fine CaO—$Al_2O_3$ generated was reduced, and it was possible to limit generation of inclusions that aggregated and coarsened before casting.

Example 2

Slabs having chemical components (mass %, with the remainder consisting of Fe and impurities) shown in Table 3 were produced.

TABLE 3

| Steel type No. | C | Si | Mn | P | S | Al | Cr | Mo | N | Ca | B | Ti | Nb | V | Zr | Ni | Cu | Sn | Ni + Cu + Sn |
|---|---|---|---|---|---|---|---|---|---|---|---|---|---|---|---|---|---|---|---|
| 5 | 0.243 | 0.430 | 1.13 | 0.008 | 0.0012 | 0.043 | 0.230 | — | 0.0032 | 0.0002 | 0.0023 | 0.0230 | — | — | — | — | — | — | — |
| 6 | 0.263 | 0.230 | 1.43 | 0.013 | 0.0024 | 0.034 | 0.240 | — | 0.0032 | — | 0.0019 | 0.0350 | 0.0210 | — | — | — | — | — | — |
| 7 | 0.304 | 0.230 | 1.34 | 0.012 | 0.0007 | 0.043 | 0.380 | — | 0.0054 | 0.0001 | 0.0023 | 0.0350 | 0.0530 | — | — | — | — | — | — |
| 8 | 0.303 | 0.210 | 1.31 | 0.011 | 0.0005 | 0.042 | 0.410 | — | 0.0048 | 0.0001 | 0.0021 | 0.0380 | 0.0440 | — | — | 0.130 | 0.230 | — | 0.360 |
| 9 | 0.308 | 0.230 | 1.33 | 0.009 | 0.0004 | 0.043 | 0.420 | — | 0.0043 | 0.0013 | 0.0025 | 0.0350 | 0.0530 | — | — | — | — | — | — |
| 10 | 0.305 | 0.520 | 0.73 | 0.011 | 0.0005 | 0.044 | 0.110 | 0.23 | 0.0058 | — | 0.0019 | 0.0280 | 0.0510 | — | — | — | — | — | — |
| 11 | 0.312 | 0.120 | 1.73 | 0.008 | 0.0009 | 0.034 | 0.180 | — | 0.0045 | — | 0.0024 | 0.0380 | 0.0750 | — | — | 0.530 | — | — | 0.530 |
| 12 | 0.311 | 0.130 | 1.75 | 0.009 | 0.0003 | 0.031 | 0.230 | — | 0.0044 | — | 0.0017 | 0.0230 | 0.0820 | — | — | — | — | — | — |
| 13 | 0.303 | 0.090 | 1.81 | 0.009 | 0.0004 | 0.029 | 0.210 | — | 0.0044 | 0.0003 | 0.0019 | 0.0330 | 0.0830 | — | — | — | — | 0.130 | 0.130 |
| 14 | 0.301 | 0.110 | 1.78 | 0.013 | 0.0013 | 0.032 | 0.320 | — | 0.0048 | 0.0001 | 0.0021 | 0.0320 | 0.0084 | — | — | 0.130 | 0.340 | 0.130 | 0.600 |
| 15 | 0.319 | 0.280 | 0.83 | 0.009 | 0.0005 | 0.032 | 0.230 | — | 0.0044 | — | 0.0021 | 0.0440 | — | — | — | — | — | — | — |
| 16 | 0.343 | 0.190 | 1.28 | 0.010 | 0.0011 | 0.043 | 0.220 | — | 0.0043 | 0.0003 | 0.0032 | 0.0420 | 0.0440 | — | — | — | — | — | — |
| 17 | 0.343 | 0.210 | 1.31 | 0.008 | 0.0009 | 0.034 | 0.230 | — | 0.0048 | 0.0012 | 0.0019 | 0.0350 | 0.0530 | — | — | — | — | — | — |
| 18 | 0.348 | 0.680 | 0.63 | 0.009 | 0.0011 | 0.034 | 0.230 | 0.23 | 0.0045 | 0.0002 | 0.0025 | 0.0320 | 0.0540 | — | — | — | — | — | — |
| 19 | 0.452 | 0.330 | 0.45 | 0.011 | 0.0004 | 0.044 | 0.120 | 0.28 | 0.0035 | 0.0002 | 0.0021 | 0.0390 | 0.0680 | — | — | — | — | — | — |
| 20 | 0.530 | 0.440 | 0.31 | 0.009 | 0.0011 | 0.032 | 0.180 | 0.19 | 0.0055 | 0.0001 | 0.0019 | 0.0430 | 0.0520 | — | — | — | — | — | — |
| 21 | 0.563 | 0.300 | 0.42 | 0.008 | 0.0005 | 0.042 | 0.230 | 0.11 | 0.0044 | 0.0001 | 0.0024 | 0.0420 | 0.0430 | 0.0150 | — | — | — | — | — |
| 22 | 0.312 | 0.004 | 1.32 | 0.009 | 0.0005 | 0.032 | 0.430 | — | 0.0032 | — | 0.0028 | 0.0230 | 0.0830 | — | — | — | — | — | — |
| 23 | 0.323 | 1.320 | 2.23 | 0.009 | 0.0005 | 0.053 | — | — | 0.0043 | — | 0.0026 | 0.0330 | 0.0320 | — | — | — | — | — | — |
| 24 | 0.305 | 1.820 | 0.45 | 0.014 | 0.0021 | 0.043 | 0.230 | 0.21 | 0.0032 | 0.0001 | 0.0021 | 0.0420 | 0.0230 | — | 0.0230 | — | — | — | — |
| 25 | 0.279 | 0.170 | 0.23 | 0.008 | 0.0013 | 0.032 | 0.150 | 0.14 | 0.0045 | — | 0.0024 | 0.0330 | — | — | — | — | — | — | — |
| 26 | 0.293 | 0.210 | 2.93 | 0.012 | 0.0004 | 0.044 | — | — | 0.0082 | — | 0.0015 | 0.0420 | 0.0330 | — | — | — | — | — | — |
| 27 | 0.361 | 0.430 | 0.82 | 0.013 | 0.0009 | 0.007 | 0.130 | 0.21 | 0.0043 | 0.0001 | 0.0024 | 0.0320 | 0.0430 | — | — | — | — | — | — |
| 28 | 0.323 | 0.130 | 1.32 | 0.009 | 0.0006 | 0.730 | 0.210 | — | 0.0044 | — | 0.0015 | 0.0230 | 0.0930 | — | — | — | — | — | — |
| 29 | 0.343 | 0.240 | 1.44 | 0.009 | 0.0027 | 0.034 | 0.190 | — | 0.0045 | 0.0001 | 0.0028 | 0.0310 | 0.0610 | — | — | — | — | — | — |
| 30 | 0.372 | 0.130 | 1.82 | 0.013 | 0.0043 | 0.034 | 0.320 | — | 0.0054 | — | 0.0031 | 0.0430 | 0.0230 | — | — | — | — | — | — |
| 31 | 0.343 | 0.070 | 1.13 | 0.025 | 0.0021 | 0.044 | 0.019 | 0.13 | 0.0068 | 0.0001 | 0.0031 | 0.0230 | 0.0330 | — | — | — | — | — | — |
| 32 | 0.263 | 0.120 | 0.81 | 0.011 | 0.0008 | 0.032 | 1.130 | — | 0.0032 | — | 0.0017 | 0.0340 | 0.0320 | — | — | — | — | — | — |
| 33 | 0.298 | 0.310 | 1.42 | 0.009 | 0.0012 | 0.039 | 0.230 | — | 0.0045 | — | 0.0045 | 0.0430 | 0.0330 | — | — | — | — | — | — |
| 34 | 0.273 | 0.330 | 1.13 | 0.008 | 0.0005 | 0.040 | 0.180 | — | 0.0053 | 0.0001 | 0.0083 | 0.0320 | 0.0450 | — | — | — | — | — | — |
| 35 | 0.382 | 0.130 | 1.82 | 0.012 | 0.0013 | 0.032 | 0.120 | — | 0.0093 | — | 0.0023 | 0.0350 | 0.0130 | — | — | — | — | — | — |
| 36 | 0.379 | 0.120 | 1.84 | 0.013 | 0.0015 | 0.035 | 0.120 | — | 0.0142 | — | 0.0024 | 0.0360 | 0.0140 | — | — | — | — | — | — |
| 37 | 0.289 | 0.230 | 1.35 | 0.011 | 0.0008 | 0.042 | 0.390 | — | 0.0024 | — | 0.0019 | 0.4200 | — | — | — | — | — | — | — |
| 38 | 0.291 | 0.210 | 1.33 | 0.009 | 0.0009 | 0.035 | 0.420 | — | 0.0034 | — | 0.0023 | — | 0.4600 | — | — | — | — | — | — |
| 39 | 0.293 | 0.240 | 1.31 | 0.011 | 0.0007 | 0.032 | 0.380 | — | 0.0045 | — | 0.0024 | — | — | 0.4700 | — | — | — | — | — |
| 40 | 0.288 | 0.230 | 1.29 | 0.010 | 0.0008 | 0.033 | 0.410 | — | 0.0044 | — | 0.0023 | — | — | — | 0.4700 | — | — | — | — |
| 41 | 0.293 | 0.240 | 1.31 | 0.009 | 0.0007 | 0.035 | 0.390 | — | 0.0048 | — | 0.0021 | — | 0.1200 | 0.3500 | — | — | — | — | — |
| 42 | 0.288 | 0.230 | 1.33 | 0.010 | 0.0009 | 0.034 | 0.400 | — | 0.0045 | — | 0.0023 | — | 0.1200 | — | 0.1300 | — | — | — | — |
| 43 | 0.343 | 0.190 | 1.28 | 0.010 | 0.0011 | 0.043 | 0.022 | — | 0.0043 | 0.0003 | 0.0032 | 0.0410 | 0.0440 | — | — | 1.230 | — | — | 1.230 |
| 44 | 0.343 | 0.190 | 1.28 | 0.010 | 0.0011 | 0.043 | 0.022 | — | 0.0043 | 0.0003 | 0.0032 | 0.0410 | 0.0440 | — | — | 0.430 | 1.320 | — | 1.750 |

In the secondary refining of the slab producing process, desulfurization was performed with slags containing CaO, $Al_2O_3$, $SiO_2$, and MgO using the LF.

In the first half of the secondary refining, (CaO(mass %)/$Al_2O_3$(mass %)) was controlled in a range of 1.0 to 1.5, desulfurization was efficiently performed, and in the second half of the secondary refining, (CaO(mass %)/$Al_2O_3$ (mass %)) was controlled in a range of 0.7 to 1.1. (CaO(mass %)/$Al_2O_3$ (mass %)) in the second half of the secondary refining was adjusted to be lower than that of the first half.

A slab was produced by continuous casting after the secondary refining. For the casting, casting was performed in a vertical curved continuous casting machine (vertical part: 2.5 m) in a casting speed range of 1.0 to 1.2 m/min. In addition, the time from the end of secondary refining to the start of casting was in a range of 20 to 120 minutes.

Each of the produced slabs was heated to 1,050 to 1,350° C. and was hot-rolled to obtain a hot-rolled steel sheet having a sheet thickness of 3.3 mm with a finishing temperature of 830 to 900° C. and a winding temperature of 450 to 730° C. Then, cold rolling was performed at a sheet thickness of 1.6 mm to obtain a cold-rolled steel sheet.

In addition, in some of the experiment examples, hot-dip aluminum plating, alloyed hot-dip galvanizing, or hot-dip galvanizing was performed.

In the item of "surface treatment" in Table 4, GA indicates an experiment example in which alloyed hot-dip galvanizing was performed, GI indicates an experiment example in which hot-dip galvanizing was performed, AL indicates an experiment example in which hot-dip aluminum plating was performed, and CR indicates an experiment example of a cold-rolled steel sheet in which no plating treatment was performed.

Then, these cold-rolled steel sheets and surface-treated steel sheets were heated to an austenite region of 950° C. having an $Ac_3$ point or more by furnace-heating, and then were quenched from 900° C. having an $Ac_3$ point or more by a press machine having a water-cooled mold. The shape of the mold was set as a flat sheet shape in order to evaluate characteristics after quenching. The bottom dead center holding time was set to 10 seconds, and cooling was performed with the mold. The temperature after cooling was 200° C. or lower.

A part was cut out from the hot-stamped formed product to prepare a tensile test piece. For this method, the same method as in Example 1 was used. Then, the tensile strength after quenching was determined according to the tensile test in the same method as in Example 1.

Next, the hydrogen embrittlement resistance was evaluated in the same method as in Example 1. When fracture occurred in this evaluation, the composition and the major axis of the inclusions that became the starting points of the fracture were measured by the same method as in Example 1.

In addition, the uniform elongation and the total elongation after hydrogen charging were measured by the same method as in Example 1. In addition, the size of the MnS was measured by the same method as in Example 1. Table 4 shows the tensile strength, the fracture state in the tensile test after hydrogen charging, the composition and the major axis of the inclusions that became the starting points in observation of the fracture surface, and the length of the MnS.

Here, in all the examples, the chemical components of the steel sheet for hot stamping and the chemical components of the hot-stamped member were the same as the chemical components before processing and forming shown in Table 1 and Table 3.

TABLE 4

| Experiment No. | Steel type No. | Surface treatment | Tensile strength (MPa) | Uniform elongation $El_1$ (%) | Total elongation after hydrogen charging $El_1$ (%) | $El_2/El_1 \times 100$ | Tensile after hydrogen charging | Analysis results of inclusion composition Ca | Al | O | Other | Major axis of inclusion containing CaO/$Al_2O_3$ (μm) | MnS length (μm) | Category |
|---|---|---|---|---|---|---|---|---|---|---|---|---|---|---|
| 13 | 5 | AL | 1523 | 5.0 | 8.1 | 162% | o | — | — | — | — | — | 43 | Comparative Example |
| 14 | 6 | AL | 1653 | 5.1 | 8.2 | 161% | o | — | — | — | — | — | 183 | Example |
| 15 | 7 | AL | 1919 | 4.8 | 7.5 | 156% | o | — | — | — | — | — | 63 | Example |
| 16 | 8 | AL | 1920 | 4.7 | 7.4 | 157% | o | — | — | — | — | — | 83 | Example |
| 17 | 9 | AL | 1931 | 4.8 | 2.9 | 60% | x | o | o | o | S, Si, C, Fe | 72 | 83 | Comparative Example |
| 18 | 10 | AL | 1945 | 4.8 | 7.5 | 156% | o | — | — | — | — | — | 82 | Example |
| 19 | 11 | GA | 1932 | 4.7 | 7.9 | 168% | o | — | — | — | — | — | 93 | Example |
| 20 | 12 | GA | 1932 | 4.8 | 7.5 | 156% | o | — | — | — | — | — | 0 | Example |
| 21 | 13 | GA | 1943 | 4.9 | 7.9 | 161% | o | — | — | — | — | — | 0 | Example |
| 22 | 14 | GA | 1921 | 4.9 | 7.5 | 153% | o | — | — | — | — | — | 82 | Example |
| 23 | 15 | CR | 1873 | 4.8 | 7.3 | 152% | o | — | — | — | — | — | 45 | Example |
| 24 | 16 | GR | 205.3 | 5.1 | 7.2 | 141% | o | — | — | — | — | — | 73 | Example |
| 25 | 17 | CR | 2073 | 5.0 | 2.7 | 54% | x | o | o | o | S, Si, C, Fe | 83 | 63 | Comparative Example |
| 26 | 18 | AL | 2042 | 5.3 | 7.8 | 147% | o | — | — | — | — | — | 93 | Example |
| 27 | 19 | CR | 2532 | 5.0 | 7.3 | 146% | o | — | — | — | — | — | 0 | Example |
| 28 | 20 | CR | 2932 | 5.2 | 7.3 | 140% | o | — | — | — | — | — | 104 | Example |
| 29 | 21 | CR | * | * | | | | — | — | — | — | — | 0 | Comparative Example |
| 30 | 22 | AL | 1913 | 4.9 | 7.2 | 147% | o | — | — | — | — | — | 21 | Example |
| 31 | 23 | GA | 2132 | 4.8 | 7.1 | 148% | o | — | — | — | — | — | 0 | Example |
| 32 | 24 | GA | 1882 | 4.9 | 7.2 | 147% | o | — | — | — | — | — | 202 | Example |
| 33 | 25 | GA | 1321 | 5.2 | 7.3 | 140% | o | — | — | — | — | — | 131 | Comparative Example |
| 34 | 26 | CR | 2013 | 4.9 | 7.2 | 147% | o | — | — | — | — | — | 0 | Example |

TABLE 4-continued

| Experiment No. | Steel type No. | Surface treatment | Tensile strength (MPa) | Uniform elongation $El_1$ (%) | Total elongation after hydrogen charging $El_1$ (%) | $El_2/El_1 \times 100$ | Tensile after hydrogen charging | Analysis results of inclusion composition Ca | Al | O | Other | Major axis of inclusion containing CaO/$Al_2O_3$ (μm) | MnS length (μm) | Category |
|---|---|---|---|---|---|---|---|---|---|---|---|---|---|---|
| 35 | 27 | GI | 2132 | 4.8 | 7.1 | 148% | o | — | — | — | — | — | 54 | Example |
| 36 | 28 | GI | 2234 | 4.9 | 7.2 | 147% | o | — | — | — | — | — | 43 | Example |
| 37 | 29 | CR | 2110 | 4.9 | 7.3 | 149% | o | — | — | — | — | — | 273 | Example |
| 38 | 30 | CR | 2319 | 4.7 | 3.2 | 68% | x | — | — | — | — | — | 423 | Comparative Example |
| 39 | 31 | AL | 2034 | 4.9 | 4.0 | 82% | x | — | — | — | — | — | 142 | Comparative Example |
| 40 | 32 | AL | 1583 | 4.9 | 8.3 | 169% | o | — | — | — | — | — | 55 | Comparative Example |
| 41 | 33 | AL | 1982 | 4.8 | 8.2 | 171% | o | — | — | — | — | — | 82 | Example |
| 42 | 34 | AL | 1741 | 5.1 | 8.3 | 163% | o | — | — | — | — | — | 0 | Example |
| 43 | 35 | AL | 2219 | 5.3 | 8.4 | 158% | o | — | — | — | — | — | 132 | Example |
| 44 | 36 | AL | 2273 | 5.2 | 8.3 | 160% | o | — | — | — | — | — | 104 | Example |
| 45 | 37 | GA | 1714 | 4.6 | 7.4 | 161% | o | — | — | — | — | — | 73 | Example |
| 46 | 38 | GA | 1743 | 4.8 | 7.3 | 152% | o | — | — | — | — | — | 72 | Example |
| 47 | 39 | AL | 1721 | 4.7 | 7.5 | 160% | o | — | — | — | — | — | 34 | Example |
| 48 | 40 | AL | 1713 | 4.8 | 7.3 | 152% | o | — | — | — | — | — | 93 | Example |
| 49 | 41 | CR | 1709 | 4.9 | 7.2 | 147% | o | — | — | — | — | — | 73 | Example |
| 50 | 42 | CR | 1723 | 5.0 | 7.3 | 146% | o | — | — | — | — | — | 92 | Example |
| 51 | 43 | AL | 2053 | 4.8 | 7.4 | 154% | o | — | — | — | — | — | 103 | Example |
| 52 | 44 | AL | 2053 | 4.9 | 7.5 | 153% | o | — | — | — | — | — | 82 | Example |

The results of Table 4 will be described below.

In Experiment No. 13, since the amount of C was equal to or lower than the limit, the tensile strength was insufficient.

Experiment Nos. 17 and 25 were produced by a method of inhibiting generation of CaO—$Al_2O_3$ during secondary refining, and for comparison, there were experiment examples in which metallic Ca was added thereafter.

Therefore, in Experiment Nos. 17 and 25, coarse CaO—$Al_2O_3$ was generated, and the hydrogen embrittlement resistance was lowered.

Experiment No. 29 was an example in which the strength was excessively increased since the amount of C was equal to or more than the limit. Under this condition, embrittlement fracture occurred before the tensile strength was measured in the tensile test. For reference, when the Vickers hardness was measured after the cross section of the steel sheet was mirror-polished, a value of 681 was shown.

In addition, this material had inferior hydrogen embrittlement resistance because of an excessive increase in strength, and although no coarse inclusions were found on the fracture surface, the grain boundary fracture surface specific to hydrogen embrittlement was exhibited.

In Experiment No. 33, since the amount of Mn added was equal to or less than the range of the present invention, the hardenability was insufficient, and the tensile strength was lowered.

In Experiment No. 38, since the amount of S added was equal to or more than the range of the present invention, coarse MnS was generated, and thus hydrogen embrittlement resistance was lowered and fracture occurred.

In Experiment No. 39, since the amount of P added was equal to or more than the range of the present invention, hydrogen embrittlement resistance was lowered and fracture occurred.

In Experiment No. 40, since the amount of Cr added was equal to or more than the range of the present invention, iron carbides present before hot stamping were stabilized and were not sufficiently dissolved by heating during hot stamping, and thus the tensile strength was lowered.

In another experiment example, it was possible to produce a hot-stamped member which satisfied the requirements of the present invention, and which had a tensile strength of 1,600 MPa or more and excellent hydrogen embrittlement resistance.

Example 3

In order to appropriately control the inclusions in the chemical components of the steel types Nos. 1 to 4 shown in Table 1, three types of secondary refining methods A, B, and C of Example 1 were performed, and the results thereof were compared. The results are shown in Table 5.

A slab was produced by continuous casting after the secondary refining. For the casting, casting was performed in a vertical curved continuous casting machine (vertical part: 2.5 m) in a casting speed range of 1.0 to 1.2 m/min. In addition, the time from the end of secondary refining to the start of casting was in a range of 20 to 120 minutes.

Each of the produced slabs was heated to 1,050 to 1,350° C. and hot-rolled to obtain a hot-rolled steel sheet having a sheet thickness of 3.3 mm with a finishing temperature of 830 to 900° C. and a winding temperature of 450 to 730° C. Then, cold rolling was performed at a sheet thickness of 1.6 mm to obtain a cold-rolled steel sheet.

In addition, hot-dip aluminum plating or alloyed hot-dip galvanizing was performed on the cold-rolled steel sheets of Experiment Nos. 53 to 61. Then, these cold-rolled steel sheets and surface-treated steel sheets were heated to an austenite region of 950° C. having an $Ac_3$ point or more for 1 minute by furnace-heating, and then were quenched so that the average cooling rate was 30 to 100° C./s. The temperature after cooling was 200° C. or lower. A thermodynamic tester was used to perform such heating and quenching.

Then, a part was cut out from the cold-rolled steel sheet to prepare a tensile test piece.

In the case of a sample material having a plating layer, the plating layer was removed by chemical treatment or mechanical grinding before the tensile test piece was collected.

In the case of aluminum plating, the sample was immersed in 20% caustic soda for 24 hours, and then was immersed in a solution in which an inhibitor (Hibiron commercially available from SUGIMURA Chemical Industrial Co., Ltd.) for preventing dissolution of iron was added in 18% hydrochloric acid for 3 hours, and the pickling residue generated on the surface was removed.

In the case of zinc plating, the sample was immersed in a solution in which an inhibitor (Hibiron commercially available from SUGIMURA Chemical Industrial Co., Ltd.) for preventing dissolution of Fe was added in 5% hydrochloric acid for 24 hours, and the plating was removed. In the case of mechanical grinding, the plating layer was removed using a milling cutter or the like.

The collection direction of the tensile test piece was a direction perpendicular to the rolling direction of the steel material, and the shape was a shape of the JIS No. 5 tensile test piece.

Here, it is desirable that the shape of the tensile test piece be the test piece described in JIS or ISO if possible, but if it is not possible to collect the shape thereof, a shape different from the specification may be used.

Then, the test pieces were evaluated by the same method as in Example 1. The results are shown in Table 5.

TABLE 5

| Experiment No. | Steel type No. | Secondary refining method | Surface treatment | Tensile strength (MPa) | Uniform elongation $El_3$ (%) | Total elongation after hydrogen charging $El_4$ (%) | $El_4/El_3 \times 100$ | Tensile after hydrogen charging | Analysis results of inclusion composition Ca | Al | O | Other | Major axis of inclusion containing $CaO/Al_2O_3$ (μm) | MnS length (μm) | Category |
|---|---|---|---|---|---|---|---|---|---|---|---|---|---|---|---|
| 53 | 1 | A | GA | 1795 | 5.2 | 7.9 | 152% | O | — | — | — | — | — | 75 | Example |
| 54 | 1 | B | GA | 1737 | 5.0 | 3.2 | 64% | X | O | O | O | S, Si, Fe, C | 63 | 33 | Comparative Example |
| 55 | 1 | C | GA | 1743 | 5.2 | 2.1 | 40% | X | O | O | O | S, Si, Fe, C | 90 | 0 | Comparative Example |
| 56 | 2 | A | AL | 1893 | 5.4 | 7.4 | 137% | O | — | — | — | — | — | 0 | Example |
| 57 | 2 | B | AL | 1939 | 4.7 | 2.9 | 62% | X | O | O | O | S, Fe, C | 54 | 0 | Comparative Example |
| 58 | 2 | C | AL | 1909 | 5.0 | 2.2 | 44% | X | O | O | O | S, Si, Fe, C | 125 | 0 | Comparative Example |
| 59 | 3 | A | AL | 2041 | 5.0 | 6.8 | 136% | O | — | — | — | — | — | 39 | Example |
| 60 | 3 | B | AL | 2035 | 4.8 | 2.7 | 56% | X | O | O | O | S, Si, Fe, C | 79 | 14 | Comparative Example |
| 61 | 3 | C | AL | 2184 | 5.0 | 2.0 | 40% | X | O | O | O | S, Si, Fe, C | 119 | 0 | Comparative Example |
| 62 | 4 | A | CR | 2494 | 4.4 | 7.1 | 161% | O | — | — | — | — | — | 50 | Example |
| 63 | 4 | B | CR | 2518 | 5.2 | 3.1 | 60% | X | O | O | O | S. Fe, C | 55 | 0 | Comparative Example |
| 64 | 4 | C | CR | 2529 | 5.2 | 2.4 | 46% | X | O | O | O | S, Si, Fe, C | 106 | 0 | Comparative Example |

In Experiment Nos. 54, 57, 60, and 63 performed by the secondary refining method B, it was confirmed that fracture occurred in the tensile test after hydrogen charging, and inclusions having a major axis of 50 μm or more and containing $CaO—Al_2O_3$ were present as the starting points from observation of the fracture surface.

It is thought to be caused since ($CaO$(mass %)/$Al_2O_3$ (mass %)) of the slag was high during desulfurization using a conduction type ladle refining furnace (LF) in secondary refining, the amount of inclusions containing fine $CaO—Al_2O_3$ generated was large, and aggregation and coarsening occurred before casting.

In Experiment Nos. 55, 58, 61, and 64 performed by the secondary refining method C, it was confirmed that fracture occurred in the tensile test after hydrogen charging, and inclusions having a major axis of 50 μm or more and containing $CaO—Al_2O_3$ were present as the starting points from observation of the fracture surface.

It is thought that since a desulfurizing agent containing CaO was injected into the steel in an injection type ladle refining furnace in secondary refining, the desulfurizing agent remained in the molten steel, and inclusions containing $CaO—Al_2O_3$ were generated.

In Experiment Nos. 53, 56, 59, and 62 performed by the secondary refining method A, no fracture occurred in the tensile test after hydrogen charging, the tensile strength and the size of MnS were within the range of the present invention, and a hot stamping part having excellent hydrogen embrittlement resistance could be realized.

In the secondary refining method A, regarding ($CaO$(mass %)/$Al_2O_3$ (mass %)) of the slag in the first half and the second half of the treatment using a conduction type ladle refining furnace (LF), the ratio in the second half was adjusted to be lower than in the first half in order to control desulfurization and the inclusion composition. It is thought that when ($CaO$(mass %)/$Al_2O_3$ (mass %)) of the slag in the second half of the secondary refining was lowered, the amount of inclusions containing fine $CaO—Al_2O_3$ generated was reduced, and it was possible to limit generation of inclusions that aggregated and coarsened before casting.

As shown in Example 3, the results of the experiment examples regarding the steel sheet for hot stamping showed the same tendency as the results of the experiment examples of the hot-stamped members of Example 1.

Example 4

In order to examine the secondary refining method A of Example 1 in more detail, secondary refining was performed by changing (CaO(mass %)/$Al_2O_3$ (mass %)) of the first half and (CaO(mass %)/$Al_2O_3$(mass %)) of the second half of the LF treatment from the following condition A-1 to condition A-3, and the results thereof were compared.

Condition A-1: (CaO(mass %)/$Al_2O_3$(mass %)) of the first half of the LF treatment was 1.2 or more and 1.5 or less, and (CaO(mass %)/$Al_2O_3$ (mass %)) of the second half of the LF treatment was 0.7 or more and 0.9 or less Condition A-2: (CaO(mass %)/$Al_2O_3$(mass %)) of the first half of the LF treatment was more than 1.0 and 1.2 or less in the first half, and (CaO(mass %)/$Al_2O_3$(mass %)) of the second half of the LF treatment was 0.9 or more and less than 1.0

Condition A-3: (CaO(mass %)/$Al_2O_3$ (mass %)) of the first half of the LF treatment was more than 1.1 and 1.2 or less in the first half, and (CaO(mass %)/$Al_2O_3$ (mass %)) of the second half of the LF treatment was 1.0 or more and less than 1.1

The target chemical components were shown in the steel types Nos. 1 to 4 shown in Table 1, and the chemical components of the steel sheets changed depending on the conditions of the secondary refining. Table 6 shows the actual values of the chemical components. In addition, the test results are shown in Table 7.

Then, cold rolling was performed at a sheet thickness of 1.6 mm to obtain a cold-rolled steel sheet. In addition, hot-dip aluminum plating or alloyed hot-dip galvanizing was performed on the cold-rolled steel sheets of Experiment Nos. 65 to 73.

Then, these cold-rolled steel sheets and surface-treated steel sheets were heated to an austenite region of 950° C. having an $Ac_3$ point or more for 1 minute by furnace-heating, and then were quenched so that the average cooling rate was 30 to 100° C./s. The temperature after cooling was 200° C. or lower. A thermodynamic tester was used to perform such heating and quenching.

Then, a part was cut out from the cold-rolled steel sheet to prepare a tensile test piece. In the case of a sample material having a plating layer, the plating layer was removed by chemical treatment or mechanical grinding before the tensile test piece was collected.

In the case of aluminum plating, the sample was immersed in 20% caustic soda for 24 hours, and then was immersed in a solution in which an inhibitor (Hibiron commercially available from SUGIMURA Chemical Industrial Co., Ltd.) for preventing dissolution of iron was added in 18% hydrochloric acid for 3 hours, and the pickling residue generated on the surface was removed.

TABLE 6

| Steel type No. | Secondary refining method | C | Si | Mn | P | S | Al | Cr | Mo | N | Ca | B |
|---|---|---|---|---|---|---|---|---|---|---|---|---|
| 45 | A-1 | 0.274 | 0.492 | 1.46 | 0.008 | 0.0004 | 0.054 | 0.242 | 0.10 | 0.0043 | 0.0001 | 0.0022 |
| 46 | A-2 | 0.273 | 0.471 | 1.44 | 0.009 | 0.0016 | 0.055 | 0.237 | 0.11 | 0.0044 | 0.0002 | 0.0024 |
| 47 | A-3 | 0.275 | 0.483 | 1.44 | 0.008 | 0.0009 | 0.052 | 0.241 | 0.11 | 0.0040 | 0.0005 | 0.0025 |
| 48 | A-1 | 0.313 | 0.232 | 1.33 | 0.011 | 0.0003 | 0.040 | 0.383 | — | 0.0055 | 0.0001 | 0.0023 |
| 49 | A-2 | 0.311 | 0.223 | 1.34 | 0.012 | 0.0012 | 0.038 | 0.377 | — | 0.0051 | 0.0003 | 0.0024 |
| 50 | A-3 | 0.312 | 0.242 | 1.35 | 0.012 | 0.0011 | 0.039 | 0.381 | — | 0.0053 | 0.0004 | 0.0023 |
| 51 | A-1 | 0.348 | 0.514 | 0.73 | 0.010 | 0.0006 | 0.043 | 0.116 | 0.21 | 0.0054 | 0.0000 | 0.0020 |
| 52 | A-2 | 0.349 | 0.518 | 0.72 | 0.011 | 0.0014 | 0.044 | 0.117 | 0.22 | 0.0053 | 0.0002 | 0.0019 |
| 53 | A-3 | 0.347 | 0.521 | 0.74 | 0.011 | 0.0008 | 0.043 | 0.122 | 0.22 | 0.0056 | 0.0005 | 0.0019 |
| 54 | A-1 | 0.441 | 0.332 | 0.44 | 0.010 | 0.0005 | 0.043 | 0.122 | 0.28 | 0.0034 | 0.0001 | 0.0021 |
| 55 | A-2 | 0.442 | 0.327 | 0.46 | 0.011 | 0.0017 | 0.044 | 0.116 | 0.28 | 0.0033 | 0.0003 | 0.0022 |
| 56 | A-3 | 0.442 | 0.333 | 0.46 | 0.011 | 0.0013 | 0.044 | 0.131 | 0.28 | 0.0034 | 0.0005 | 0.0022 |

| Steel type No. | Ti | Nb | V | Zr | Ni | Cu | Sn | Ni + Cu + Sn |
|---|---|---|---|---|---|---|---|---|
| 45 | 0.0441 | — | 0.0452 | — | — | — | — | — |
| 46 | 0.0432 | — | 0.0447 | — | — | — | — | — |
| 47 | 0.0463 | — | 0.0443 | — | — | — | — | — |
| 48 | 0.0361 | 0.0512 | — | — | 0.013 | 0.011 | 0.002 | 0.026 |
| 49 | 0.0354 | 0.0487 | — | — | 0.011 | 0.011 | 0.002 | 0.024 |
| 50 | 0.0357 | 0.0523 | — | — | 0.009 | 0.011 | 0.002 | 0.022 |
| 51 | 0.0291 | 0.0502 | — | 0.0120 | — | — | — | — |
| 52 | 0.0292 | 0.0521 | — | 0.0111 | — | — | — | — |
| 53 | 0.0287 | 0.0518 | — | 0.0132 | — | — | — | — |
| 54 | 0.0393 | 0.0677 | — | — | 0.120 | 0.230 | 0.120 | 0.470 |
| 55 | 0.0388 | 0.0681 | — | — | 0.120 | 0.220 | 0.120 | 0.460 |
| 56 | 0.0392 | 0.0683 | — | — | 0.110 | 0.230 | 0.110 | 0.450 |

A slab was produced by continuous casting after the above secondary refining. For the casting, casting was performed in a vertical curved continuous casting machine (vertical part: 2.5 m) in a casting speed range of 1.0 to 1.2 m/min. In addition, the time from the end of secondary refining to the start of casting was in a range of 20 to 120 minutes.

Each of the produced slabs was heated to 1,050 to 1,350° C. and hot-rolled to obtain a hot-rolled steel sheet having a sheet thickness of 3.3 mm with a finishing temperature of 830 to 900° C. and a winding temperature of 450 to 730° C.

In the case of zinc plating, the sample was immersed in a solution in which an inhibitor (Hibiron commercially available from SUGIMURA Chemical Industrial Co., Ltd.) for preventing dissolution of Fe was added in 5% hydrochloric acid for 24 hours, and the plating was removed. In the case of mechanical grinding, the plating layer was removed using a milling cutter or the like.

The collection direction of the tensile test piece was a direction perpendicular to the rolling direction of the steel material, and the shape was a shape of the JIS No. 5 tensile test piece.

Here, it is desirable that the shape of the tensile test piece be the test piece described in JIS or ISO if possible, but if it is not possible to collect the shape thereof, a shape different from the specification may be used.

Then, the test pieces were evaluated by the same method as in Example 1. The results are shown in Table 7.

TABLE 7

| Experiment No. | Steel type No. | Secondary refining method | Surface treatment | Tensile strength (MPa) | Uniform elongation $El_3$ (%) | Total elongation after hydrogen charging $El_4$ (%) | $El_4/El_3 \times 100$ | Tensile after hydrogen charging | Analysis results of inclusion composition Ca | Al | O | Other | Major axis inclusion containing $CaO/Al_2O_3$ (μm) of | MnS length (μm) | Category |
|---|---|---|---|---|---|---|---|---|---|---|---|---|---|---|---|
| 65 | 45 | A-1 | GA | 1794 | 5.2 | 7.8 | 150% | O | — | — | — | — | — | 34 | Example |
| 66 | 46 | A-2 | GA | 1796 | 5.1 | 6.8 | 133% | O | — | — | — | — | — | 83 | Example |
| 67 | 47 | A-3 | GA | 1793 | 5.2 | 6.1 | 117% | O | — | — | — | — | — | 104 | Example |
| 68 | 48 | A-1 | AL | 1895 | 5.3 | 7.3 | 138% | O | — | — | — | — | — | 33 | Example |
| 69 | 49 | A-2 | AL | 1899 | 5.3 | 6.9 | 130% | O | — | — | — | — | — | 72 | Example |
| 70 | 50 | A-3 | AL | 1893 | 5.2 | 6.2 | 119% | O | — | — | — | — | — | 93 | Example |
| 71 | 51 | A-1 | AL | 2044 | 5.1 | 7.1 | 139% | O | — | — | — | — | — | 38 | Example |
| 72 | 52 | A-2 | AL | 2040 | 5.0 | 6.5 | 130% | O | — | — | — | — | — | 73 | Example |
| 73 | 53 | A-3 | AL | 2042 | 5.1 | 6.1 | 120% | O | — | — | — | — | — | 103 | Example |
| 74 | 54 | A-1 | CR | 2499 | 4.5 | 7.0 | 156% | O | — | — | — | — | — | 31 | Example |
| 75 | 55 | A-2 | CR | 2493 | 4.4 | 6.5 | 148% | O | — | — | — | — | — | 77 | Example |
| 76 | 56 | A-3 | CR | 2493 | 4.5 | 5.3 | 118% | O | — | — | — | — | — | 92 | Example |

In Experiment Nos. 65, 68, 71, and 74 performed by the secondary refining method A-1, no fracture occurred in the tensile test after hydrogen charging, the tensile strength and the size of MnS were within the range of the present invention, and a hot stamping part having excellent hydrogen embrittlement resistance could be realized.

In Experiment Nos. 66, 69, 72, and 75 performed by the secondary refining method A-2, although no fracture occurred in the tensile test after hydrogen charging, the total elongation had a lower value than that performed by the secondary refining method A-1.

In Experiment Nos. 67, 70, 73, and 76 performed by the secondary refining method A-3, although no fracture occurred in the tensile test after hydrogen charging, the total elongation had a lower value than that performed by the secondary refining methods A-1 and A-2.

Based on the above results, it can be understood that it is desirable to set (CaO(mass %)/$Al_2O_3$ (mass %)) of the first half to be larger than (CaO(mass %)/$Al_2O_3$ (mass %)) of the second half of the LF treatment, and (CaO(mass %)/$Al_2O_3$ (mass %)) of the first half and (CaO(mass %)/$Al_2O_3$(mass %)) of the second half of the LF treatment to be within different ranges.

INDUSTRIAL APPLICABILITY

According to the present invention, it is possible to provide a hot-stamped member and a steel sheet for hot stamping which can prevent hydrogen embrittlement cracks while maintaining a desired tensile strength, and which are extremely useful industrially.

The invention claimed is:

1. A hot-stamped member having a chemical composition including, in mass %,

C: 0.25% or more and 0.55% or less,

Si: 0.001% or more and 2.0% or less,

Mn: 0.3% or more and 3.0% or less,

P: 0.02% or less,

S: 0.003% or less,

Al: 0.005% or more and 1.0% or less,

Cr: 0% or more and 1.0% or less,

Mo: 0% or more and 1.0% or less,

N: 0.02% or less,

Ca: 0% or more and 0.0010% or less,

B: 0.0005% or more and 0.01% or less, at least one selected from the group of Ti: 0.005% or more and 0.5% or less, Nb: 0.005% or more and 0.5% or less, V: 0.005% or more and 0.5% or less, and Zr: 0.005% or more and 0.5% or less, Ni+Cu+Sn: 0% or more and 2% or less, and a remainder comprising Fe and impurities, wherein a tensile strength of the hot-stamped member left in the air at a room temperature of 20 to 30° C. for 48 hours or longer exceeds 1600 MPa, and wherein a major axis of an inclusion containing CaO—$Al_2O_3$ contained in the hot-stamped member is 50 μm or less.

2. The hot-stamped member according to claim 1, wherein a maximum length of MnS present in a central part of a sheet thickness is 300 μm or less.

3. The hot-stamped member according to claim 2, including, in mass %,

Ni+Cu+Sn: 0.005% or more and 2% or less.

4. The hot-stamped member according to claim 2, wherein a plating layer is provided on a surface.

5. The hot-stamped member according to claim 1, including, in mass %,

Ni+Cu+Sn: 0.005% or more and 2% or less.

6. The hot-stamped member according to claim 1, wherein a plating layer is provided on a surface.

7. A hot-stamped member having a chemical composition including, in mass %,

C: 0.25% or more and 0.55% or less,

Si: 0.001% or more and 2.0% or less,

Mn: 0.3% or more and 3.0% or less,

P: 0.02% or less,

S: 0.003% or less,

Al: 0.005% or more and 1.0% or less,

Cr: 0% or more and 1.0% or less,

Mo: 0% or more and 1.0% or less,

N: 0.02% or less,

Ca: 0% or more and 0.0010% or less,

B: 0.0005% or more and 0.01% or less, at least one selected from the group of Ti: 0.005% or more and 0.5% or less, Nb: 0.005% or more and 0.5% or less, V: 0.005% or more and 0.5% or less, and Zr: 0.005% or more and 0.5% or less, Ni+Cu+Sn: 0% or more and 2% or less, and a remainder comprising Fe and impurities, wherein a tensile strength of the hot-stamped member left in the air at a room temperature of 20 to 30° C. for 48 hours or longer exceeds 1600 MPa, wherein, when a uniform elongation is $El_1$ (%) and a total elongation measured using a tensile test piece of the hot-stamped member charged with hydrogen so that an amount of diffusible hydrogen is 0.5±0.1 wt. ppm is $El_2$ (%), $(El_2/El_1)\times100\geq100$(%) is satisfied.

8. The hot-stamped member according to claim 7, wherein a maximum length of MnS present in a central part of a sheet thickness is 300 μm or less.

9. The hot-stamped member according to claim 7, including, in mass %,

Ni+Cu+Sn: 0.005% or more and 2% or less.

10. The hot-stamped member according to claim 7, wherein a plating layer is provided on a surface.

11. A steel sheet for hot stamping having a chemical composition including, in mass %, C: 0.25% or more and 0.55% or less, Si: 0.001% or more and 2.0% or less, Mn: 0.3% or more and 3.0% or less, P: 0.02% or less, S: 0.003% or less, Al: 0.005% or more and 1.0% or less, Cr: 0% or more and 1.0% or less, Mo: 0% or more and 1.0% or less, N: 0.02% or less, Ca: 0% or more and 0.0010% or less, B: 0.0005% or more and 0.01% or less, at least one selected from the group of Ti: 0.005% or more and 0.5% or less, Nb: 0.005% or more and 0.5% or less, V: 0.005% or more and 0.5% or less, and Zr: 0.005% or more and 0.5% or less, Ni+Cu+Sn: 0% or more and 2% or less, and a remainder comprising Fe and impurities, wherein a tensile strength measured using a tensile test piece obtained by heating the steel sheet for hot stamping at 950° C. for 1 minute and then cooling to 200° C. or lower at an average cooling rate of 30 to 100° C./s, the steel sheet for hot stamping being left in the air at a room temperature of 20 to 30° C. for 48 hours or longer, exceeds 1600 MPa, and wherein a major axis of an inclusion containing CaO—$Al_2O_3$ contained in the steel sheet for hot stamping is 50 μm or less.

12. The steel sheet for hot stamping according to claim 11, wherein a maximum length of MnS present in a central part of a sheet thickness is 300 μm or less.

13. The steel sheet for hot stamping according to claim 12, including, in mass %, Ni+Cu+Sn: 0.005% or more and 2% or less.

14. The steel sheet for hot stamping according to claim 12, wherein a plating layer is provided on a surface.

15. The steel sheet for hot stamping according to claim 11, including, in mass %, Ni+Cu+Sn: 0.005% or more and 2% or less.

16. The steel sheet for hot stamping according to claim 11, wherein a plating layer is provided on a surface.

17. A steel sheet for hot stamping having a chemical composition including, in mass %, C: 0.25% or more and 0.55% or less, Si: 0.001% or more and 2.0% or less, Mn: 0.3% or more and 3.0% or less, P: 0.02% or less, S: 0.003% or less, Al: 0.005% or more and 1.0% or less, Cr: 0% or more and 1.0% or less, Mo: 0% or more and 1.0% or less, N: 0.02% or less, Ca: 0% or more and 0.0010% or less, B: 0.0005% or more and 0.01% or less, at least one selected from the group of Ti: 0.005% or more and 0.5% or less, Nb: 0.005% or more and 0.5% or less, V: 0.005% or more and 0.5% or less, and Zr: 0.005% or more and 0.5% or less, Ni+Cu+Sn: 0% or more and 2% or less, and a remainder comprising Fe and impurities, wherein a tensile strength measured using a tensile test piece obtained by heating the steel sheet for hot stamping at 950° C. for 1 minute and then cooling to 200° C. or lower at an average cooling rate of 30 to 100° C./s, the steel sheet for hot stamping being left in the air at a room temperature of 20 to 30° C. for 48 hours or longer, exceeds 1600 MPa, and wherein, when a uniform elongation is $El_3$ (%) and a total elongation measured using the tensile test piece charged with hydrogen so that an amount of diffusible hydrogen is 0.5±0.1 wt. ppm is $El_4$ (%), $(El_4/El_3)\times100\geq100$(%) is satisfied.

18. The steel sheet for hot stamping according to claim 17, wherein a maximum length of MnS present in a central part of a sheet thickness is 300 μm or less.

19. The steel sheet for hot stamping according to claim 17, including, in mass %, Ni+Cu+Sn: 0.005% or more and 2% or less.

20. The steel sheet for hot stamping according to claim 17, wherein a plating layer is provided on a surface.

* * * * *